US005575830A

United States Patent [19]

Yamashita et al.

[11] Patent Number: 5,575,830

[45] Date of Patent: Nov. 19, 1996

[54] FABRICATION METHODS AND EQUIPMENT FOR GRANULATED POWDERS

[75] Inventors: Osamu Yamashita, Ibaraki; Tsunekazu Saigo, Mtsubara; Seiichi Kohara, Osaka; Hirokazu Kitayama, Osaka; Hiroshi Hashikawa, Osaka, all of Japan

[73] Assignee: Sumitomo Special Metals Co., Ltd., Osaka, Japan

[21] Appl. No.: 360,632

[22] Filed: Dec. 21, 1994

[51] Int. Cl.[6] ..... B22F 1/00

[52] U.S. Cl. ..... 75/348; 75/772

[58] Field of Search ..... 75/751, 772, 348

[56] References Cited

FOREIGN PATENT DOCUMENTS

| | | | |
|---|---|---|---|
| 53-110915 | 9/1978 | Japan | 75/772 |
| 54-46114 | 4/1979 | Japan | 75/772 |

*Primary Examiner*—John Sheehan

*Attorney, Agent, or Firm*—Watson Cole Stevens Davis, P.L.L.C.

[57] ABSTRACT

The purpose of this invention is to present fabrication methods and equipment for granulated powders whereby, the reaction between the R-Fe-B-type or R-Co-type rare earth containing alloy powders and the binder is controlled, the residual oxygen and carbon content of the sintered products after sintering is reduced, and whereby it is possible to obtain isotropic or anisotropic granulated powders having good powder flowability and lubrication properties when molding. After stirring a slurry of rare earth containing alloy powders formed by adding a binder consisting of water and at least one of either methyl cellulose, polyacryl amide or polyvinyl alcohol, and mixing, oriented liquid droplets are formed by applying a magnetic field to the slurry to orientate the said powder particles and spraying within the chamber of a spray dryer apparatus. By instantaneously dry solidifying these anisotropic granulated powders, it is possible to fabricate spherical granulated powders with good magnetic properties and a high flowability whereby the flowability and lubrication properties of the powder at the time of compression molding are improved, as well as improving the molding cycle and the dimensional precision of the molded product.

18 Claims, 2 Drawing Sheets

Fig, 1
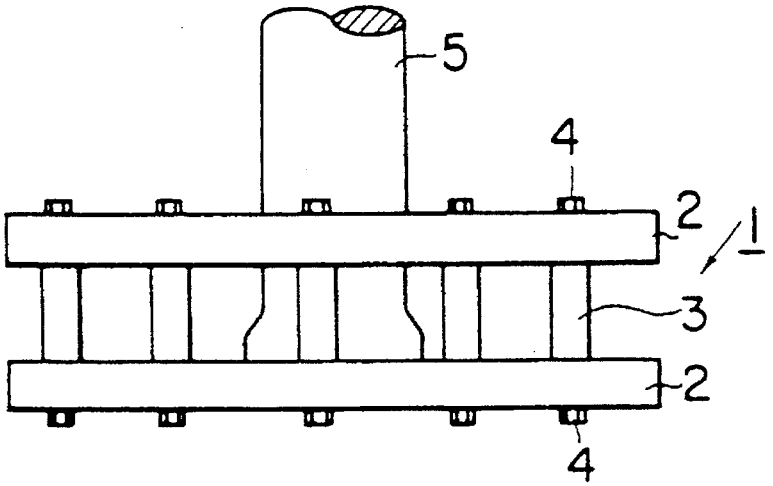
Fig, 2
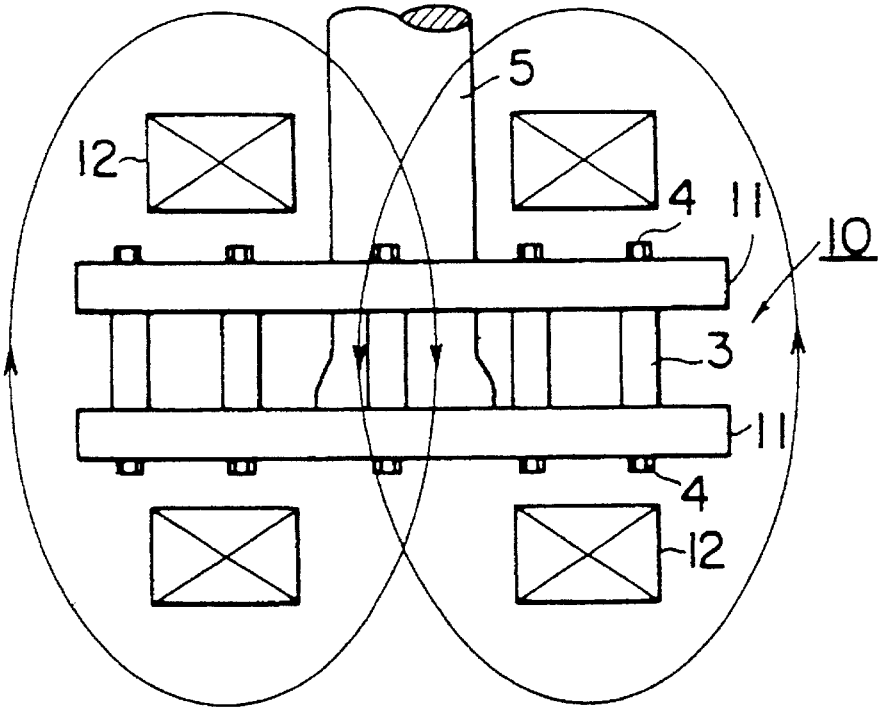

Fig, 3
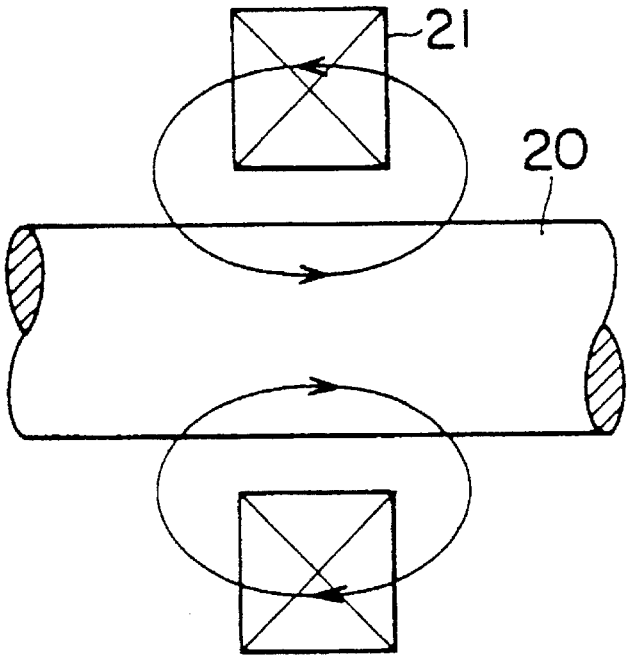
Fig, 4
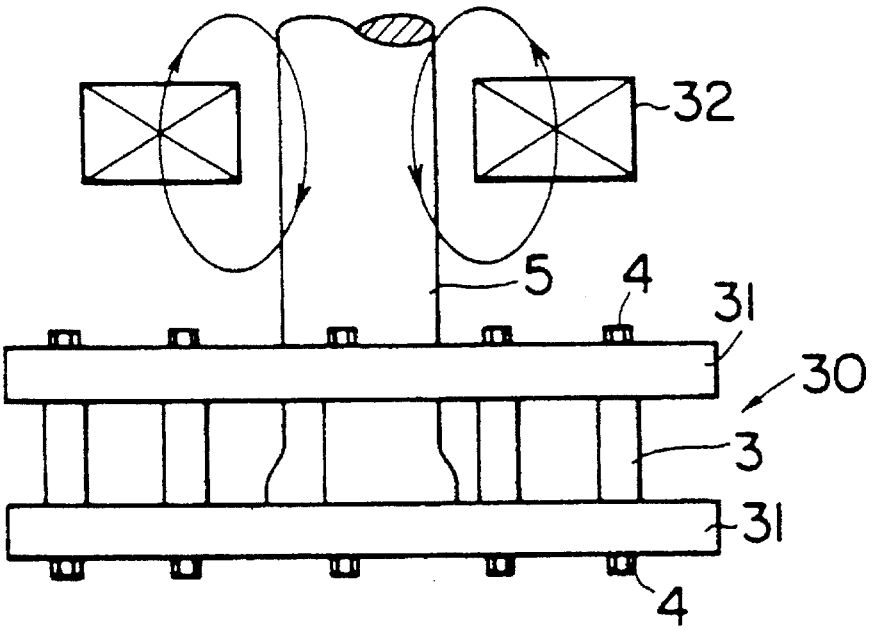

FABRICATION METHODS AND EQUIPMENT FOR GRANULATED POWDERS

BACKGROUND OF THE INVENTION

1. Field of the Invention

This invention, relating to fabrication methods and equipment for granulated powders formed from rare earth containing alloys such as R-Fe-B-type and R-Co-type alloys, regards the production of isotropic granulated powders by stirring a slurry of the said rare earth containing alloy powders, spraying within the chamber of a spray dryer apparatus to form liquid droplets and instantaneously dry solidifying them, and the production of anisotropic granulated powders by applying a magnetic field to the slurry to orientate the said powder particles, spraying in the said chamber to form orientated liquid droplets and instantaneously dry solidifying them. The invention describes these fabrication methods and the fabrication equipment for the production of isotropic and anisotropic granulated powders with good magnetic properties where the flow and lubrication properties of the powders at the time of compression molding are improved, and the molding cycle and dimensional precision are also improved.

2. Description of the Prior Art

These days, with the production of small, light-weight motors and actuators used in everything from home electrical goods to computer peripherals and motor vehicles, much effort is being made to increase their efficiency. This means small, light-weight and thin magnetic materials to be used in these motors are also being sought.

Currently, typical sintered permanent magnetic materials are ferrite magnets, R-Co-type magnets and R-Fe-B-type magnets previously suggested by the applicants (Japanese Patent Publication SHO 61-34242).

Of the above, rare earth magnets in particular, such as R-Co-type and R-Fe-B-type magnets, have exceptional magnetic characteristics compared to other magnetic materials.

The above rare earth magnets, for example, the R-Fe-B type sintered permanent magnets have extremely good magnetic properties and have a large energy product ((BH)max) that exceeds 40 MGOe, with being over 50 MGOe as the greatest energy product. In order to achieve this, it is necessary to grind alloys of the required composition to powders with an average particle size of 1~10 μm.

However, as the particle size of the alloy powders is made smaller, the flowability of the powders when molding becomes worse, and together with a reduction in the dispersion of the molded product density and the molding apparatus life span, there exists a dispersion in the dimensional precision after sintering which causes difficulties particularly in the fabrication of thin films and small shapes.

Further, rare earth magnets contain rare earth elements and iron which are easily oxidized in the atmosphere, and such, as the alloy powder particle size is made smaller, degradation of the magnetic properties due to oxidation becomes a problem.

In order to improve the_molding characteristics, additives to the alloy powders before molding have been suggested such as polyoxyethylene alkyl either (Japanese Patent Publication HEI 4-80961 (JPB4-80961)), or further adding of paraffin or stearate (Japanese Patent Publication HEI 4-80962, Japanese Patent Publication HEI 5-53842), or oleic acid (Japanese Patent Publication SHO 62-36365).

However, although the molding characteristics can be improved somewhat, the beneficial effects are limited, and the problems in molding thin films or small shapes are as yet unsolved.

Further, as well as adding binder and lubricants to the above, other methods have been proposed to improve the molding characteristics in the production of thin films and small shapes. These include granulating and molding after adding and mixing a lubricant consisting of myristic acid ethyl and oleic acid, saturated fatty carboxylic acids and unsaturated fatty carboxylic acids to the powders before molding (Japanese Patent Laid Open SHO 62-245604, JPA62-245604), or molding after adding saturated fatty carboxylic acids and unsaturated fatty carboxylic acids to a paraffin mixture, after mixing and granulating (Japanese Patent Laid Open SHO-63-237402).

However, in the above methods the binding force between the powder particles is insufficient, and as the granulated powders break apart easily, obtaining a sufficient particle flow is a problem.

In order to improve the molding characteristics and increase the binding force between powder particles, one method might be to increase the amount of added binders and lubricants. However, the amount that can be added is limited due to the fact that, as the amount of additives is increased, a reaction occurs between the R component in the rare earth containing alloy powders and the binder causing an increase in the residual oxygen and carbon content in the sintered material leading to a degradation in the magnetic properties.

Although not directly related to rare earth containing magnetic alloy powders, binders for compression molding of Co-type superalloys have been proposed where, for that particular alloy powder, a composition of mixed glycerol and boron was used containing 1.5~3.5 wt % methyl cellulose and other fixed amounts of additives (U.S. Pat. No. 4,113,480). As well, binders for injection molding of alloy powders for tools, consisting of a particular composition, have been proposed where for that particular alloy powder, a composition was used where plasticizers, such as glycerol and water, lubricants, such as wax emulsion, and parting agents were added to 0.5~2.5 wt % methyl cellulose (Japanese Patent Laid Open SHO 62-37302).

However, in order to maintain fixed flow and mold strength characteristics, for each particular alloy powder, because, as in the above examples, more than 0.5 wt % is using comparatively a lot of binder, it is essential to add various binder additives, for example, adding equal amounts of plasticizers such as glycerol to methyl cellulose, and as such, even after injection or compression molding, degreasing and sintering, there still remains much residual carbon and oxygen, and particularly in the case of rare earth magnets, the degradation in the magnetic properties makes these methods unsuitable.

For ferrite oxide powders, methods such as adding 0.6~1.0 wt % polyvinyl alcohol as a binder to powders of an average size of less than 1 μm, then producing granulated powders using a spray dryer apparatus and molding and sintering the said powders, are known.

However, for these oxide powders, as more than 0.6 wt % is using a large amount of binder, even after the degreasing process has been carried out there remains much carbon and oxygen in the sintered product and as such these are very easily oxidized or carbonized. So, as the degradation in the magnetic properties due to even a small amount of oxidation or carbonization is extreme for the rare earth containing alloy powders of this invention, the above methods used for oxides cannot be simply applied here.

In particular, in the case of oxides, even if one uses a comparatively large amount of binder, as degreasing and sintering can be done in air, one can control to some extent the amount of residual carbon by combusting the binder when degreasing and sintering. However, for the rare earth containing alloy powders of this invention, as the magnetic properties are degraded by oxidation it is not possible to perform degreasing and sintering in air and so adding large amounts of binder has an enormously bad influence on the magnetic properties of the sintered magnet obtained.

Therefore, although various methods have been proposed to improve the molding characteristics by adding various binders and lubricants to alloy powders before molding and then granulating them, in each case, these present problems for the fabrication of rare earth magnets having good magnetic properties into thin film or small shape forms, as has been required in recent years.

SUMMARY OF THE INVENTION

The purpose of this invention is to present fabrication methods and apparatus for granulated powders whereby granulated powders with the isotropy or anisotropy required to produce rare earth magnets having good magnetic properties, can be easily manufactured. In order to improve the dimensional precision of the molded product and the manufacturing and magnetic characteristics, this invention presents fabrication methods and equipment for granulated powders whereby it is possible to obtain isotropic and anisotropic granulated powders having good powder flowability and lubrication characteristics for molding by controlling the reaction between the rare earth containing alloy powder and the binder and so reducing the amount of residual oxygen and carbon in the sintered product after sintering.

The inventors, as the result of various investigations into fabrication methods for the production of isotropic granulated powders with good molding characteristics, have produced granulated powders of the required average particle size from a slurry by, using a rotary disk-type spray dryer apparatus, adding magnetic powders and an appropriate binder and mixing to form a slurry and then spraying and drying the said slurry. Then, on molding the said granulated powders, they have been able to efficiently obtain anisotropic sintered permanent magnets having extremely good magnetic properties in thin film and small shape form, whereby the dimensional precision after sintering is also extremely good and, due to the sufficient binding force between the granulated powders themselves, there is also a remarkable improvement in the powders flowability without worsening the dispersion of the molded product density or reducing the life span of the mold apparatus.

Further, the inventors, as the result of various investigations into fabrication methods and equipment for the production of anisotropic granulated powders, have produced anisotropic granulated powders of the required average particle size by, using the above fabrication process for isotropic granulated powders where a rotary disk-type spray dryer apparatus is used, whereby the rotary disk is partially or entirely composed of a permanent magnet or is magnetized partially or entirely using an electromagnet, or where a permanent magnet or electromagnet is placed in the environs of the raw slurry supply pipe or the slurry supply shaft of the upper portion of the rotary disk, and thereby applying a magnetic field along the slurry supply route to the rotary disk, and then spraying and drying the said slurry, whereby the magnetic powder particles within the said slurry are orientated and anisotropized. Then, on molding the said granulated powders, they have been able to efficiently obtain anisotropic sintered permanent magnets having extremely good magnetic properties in thin film and small shape form, whereby the dimensional precision after sintering is also extremely good and, due to the sufficient binding force between the granulated powders themselves, along with their inherent anisotropicity, there is also a remarkable improvement in the powder's flowability without worsening the dispersion of the molded product density or reducing the life span of the mold apparatus.

Further, the inventors, as the result of various investigations into binders where the reaction with the rare earth containing alloy powders is controlled and the residual oxygen and carbon content of the sintered product are reduced, have, by using a binder consisting of water and a small amount of at least one of either methyl cellulose, polyacryl amide or polyvinyl alcohol, succeeded in controlling the reaction between the binder and the rare earth containing alloy powder which occurs in the process before sintering, and so have succeeded in greatly reducing the amounts of residual oxygen and carbon in the sintered product after sintering.

As well, when using each of the above binders methyl cellulose, polyacryl amide or polyvinyl alcohol independently, even for the addition of just 0.5 wt % of binder, the one dimensional particle binding force is sufficiently strong to withstand the vibration within the powder supply feeder when molding, and when a composite of binders is used, we can obtain the same effect with less than 0.4 wt %. Further, an extremely small amount of lubricant of less than 0.3 wt % will be sufficient and the amount of residual carbon content in the total amount of binder is greatly reduced.

For this invention, a slurry formed from adding a binder, described below, to alloy powders and mixing is formed into granulated powders using a spray dryer apparatus, also described below. We first describe the fabrication method for isotropic and anisotropic granulated powders using a spray dryer apparatus. First, the slurry is fed to the spray dryer apparatus from the slurry stirrer. This slurry is sprayed out by the centrifugal force of the rotary disk, and atomized to a mist at the tip of a high pressure nozzle. The sprayed out liquid droplets are then instantaneously dried by a flow of heated inert gas to form granulated powders which fall naturally into the lower portion of the collector.

Spray dryer apparatus

For the rotary disk of the rotary disk-type spray dryer apparatus used for fabricating the isotropic and anisotropic granulated powders of this invention, there are various types of disk including the vein-type, the chestner-type and the pin-type. In principle any of these will do as long as the rotary disk is composed of two disks, upper and lower, and can rotate.

As for the construction of the spray dryer apparatus as a whole, as the rare earth containing alloy powders for granulation are extremely easily oxidized it should be possible to fill in the slurry receptor and granulated powder collector sections with an inert gas, and an airtight construction maintaining a usual oxygen concentration of less than 3% is desirable.

Further, for the construction of the collection section of the spray dryer apparatus, an injection outlet to inject heated inert gases should be placed in the region of the rotary disk in order to instantaneously dry the liquid droplets sprayed out by the said rotary disk, and an exhaust outlet should be placed in the lower portion of the collector section to exhaust the injected gas to the outer portion of the collector section. At this time, care should be taken not to allow the temperature of the externals of the apparatus and the associated heaters to cause the temperature of the heated inert gas to fall, and as such, it is desirable to maintain the injection outlet at a temperature similar to that of the inert gas, for example, at 60°~150° C.

If the temperature of the inert gas falls, the sprayed out liquid droplets cannot sufficiently dry in a short time and the slurry supply must be reduced, thus lowering efficiency.

Further, when producing granulated powders of comparatively large size, the number of rotations by the rotary disk is reduced, so a fall in the temperature of the inert gas means the sprayed out liquid droplets cannot sufficiently dry and, as a result, the slurry supply is reduced severely reducing efficiency.

Therefore, it is desirable to maintain the temperature of the heated inert gas while exhausting it to the outer portions of the collector section, and to maintain the temperature of the injection outlet at 60°~150° C., with 100° C. being most desirable.

Further, as there is a trend for the treatment efficiency to fall when there is only a small temperature difference between the injection outlet and the exhaust outlet, the exhaust outlet temperature should be below 50° C., preferably below 40° C., and at best at room temperature.

For the inert gas, nitrogen gas or argon gas is desirable with the heating temperature best at 60°~150° C.

Rotary disk-type spray dryer apparatus for anisotropic granulated powders.

For the above spray dryer apparatus, particularly for a rotary disk-type spray dryer apparatus for producing anisotropic granulated powders, for the chestner-type we have a gap which means that even if we orientate the powder particles in a magnetic field, the anisotropized liquid droplets will have their orientation disordered when they fly out from the disk, and this type of disk is not suitable for anisotropizing granulated powders. For the vein-type, in the same way, if the holes and slits on the circumference are small, the orientation will be disordered but if the holes and slits on the disk surface are made large, we can anisotropize the powder. The most suitable type of disk for the anisotropization of granulated powders is the pin-type which is desirable as it can be of a relatively simple structure made from a permanent magnet or electromagnet, and a magnetic field can be applied perpendicular to the disk surface.

The disk may be constructed from non-magnetic materials such as ordinary stainless steel but, for example, if the disk is partially constructed from a permanent magnet, a structure where permanent magnets are buried in appropriate sections of the disk or in a radiating pattern can be adopted, or for a disk to be partially or entirely magnetized by an electromagnet, magnetic material can be buried in appropriate positions within a disk made from non-magnetic material.

Further, if the disk is constructed from a permanent magnet (see FIG. 1), it is best to cover it with an expandable soft magnetic metal to avoid damage to the permanent magnet. If the disk is of a structure to be magnetized by an electromagnet (FIG. 2), for example, by placing an electromagnet above and below a two layer disk and applying a magnetic field, it is possible to adopt structures where a magnetic field is generated between the disks, or where the entire disk is composed of an electromagnet.

For the disk, while either a permanent magnet or an electromagnet can be used, the permanent magnet has the advantages of having a simple structure and being of low cost, while it has the disadvantages of not being able to adjust the magnetic field strength during operation and of being difficult to clean when raw materials are being changed and there is also the possibility of intermixing between the magnet and the raw materials. On the other hand, the electromagnet has the advantage, unlike the permanent magnet, of being able to adjust the magnetic field strength during operation, while it has the disadvantages of having a complicated structure and of being of high cost. While both have their good and bad points, if one considers the conditions under which the granulated powders will be produced, permanent magnets may be more suitable for small scale production due to their structure and low cost, while electromagnets may be more suitable for large scale mass production. In any case it is desirable to choose the best method depending on the scale of production and the type of rare earth containing alloy powders used.

As the disk is used in an environment of high heat and humidity, for whichever structure is chosen it is best that it is composed of materials with good corrosion resistance. For example, for a permanent magnet, a surface coating of resin, paint or metal is suitable, while for a structure to be magnetized by an electromagnet, an iron-type material with high permeability and saturated flux density, as well as exceptional corrosion resistance is desirable, for example, Fe-Ni-type alloys (permalloy, etc.), Fe-Co-type alloys (Permendur, etc.) or other Fe-Ni-Cu-type alloys may be used.

For this invention, apart from the structures using a rotary disk where the disk is constructed entirely or partially from either a permanent magnet or an electromagnet, a permanent magnet or electromagnet can also be placed such that a magnetic field can be applied in an appropriate position between the slurry feed route and the rotary disk, and it is best to have a construction where a magnetic field can be applied to both the rotary disk and between the slurry feed route and the rotary disk.

For example, a permanent magnet or an electromagnet can be placed in the environs of the raw slurry supply pipe, or the slurry supply shaft in the upper portion of the rotary disk, or in both these places.

When two magnetic fields are combined to provide the orientation, that is when a field is applied to both the slurry supply pipe and the rotary disk, we obtain magnetic properties almost identical to those from a normal molded product where spray granulation is not performed as shown in Tables 5-1a and 5-1b of the examples where they are compared to cases of a single magnetic field. So, for the production of anisotropic granulated powders, the use of a combination of two magnetic fields to provide the orientation is desirable from the point of view of both quality improvement and quality control.

When combining magnetic fields to provide the orientation, for the slurry supply pipe, a removable permanent magnet is suitable from the point of view of field stability, power consumption and production costs, while for the rotary disk, a permanent magnet is suitable for small scale production while an electromagnet is suitable for mass production, as noted above.

The strength of the magnetic field required to anisotropize the granulated powders will differ according to the slurry viscosity, raw materials and the composition of the rare earth containing alloy powders, as well as the position where the magnetic field is established within the apparatus. For any of these conditions, a field greater than 2 kOe will be sufficient to anisotropize liquid droplets of tens of micrometers to hundreds of micrometers.

From an x-ray diffraction analysis of the relationship between the magnetic field strength and the amount of orientation induced in magnetic powders, it was found that 1 kOe caused 97% orientation in R-Fe-B-type powders and 1.5 kOe caused 95% orientation in Sm-Co-type powders, meaning a magnetic field of greater than 2 kOe should be sufficient to orientate the slurry.

Therefore, when using a disk constructed from a permanent magnet, it is best to use a magnet with a field strength greater than 2 kOe, and rare earth magnets, which have good magnetic properties, are suitable.

Granulated Powder.

The particle size of the obtained granulated powders can be controlled by the concentration and supply rate of the slurry fed to the spray dryer apparatus, or the number of rotations of the rotary disk. For example, for rare earth containing alloy powders of less than 20 μm particle size, there is almost no gain in the flowability of the granulated powder, while if the particle size exceeds 400 μm, the powder particles are too large causing a reduction of the packing density in the die during molding leading to a fall in the molded density, as well as causing an undesirable reduction in the density of the sintered product after sintering. As such, a granulated powder particle size of 20~400 μm is desirable with 50~200 μm being best.

As the orientated anisotropic granulated powders of the required average particle size as obtained by the fabrication apparatus of this invention will be in a magnetized state, left as they are, alike granulated powders will cohere together reducing the flowability of the powder. Therefore, it is necessary to demagnetize the said granulated powder before molding.

Demagnetization can be relatively simply performed by placing the granulated powders in a damped oscillating magnetic field with an initial greatest amplitude of 2~3 kOe. Now, in order to improve the flowability as much as possible, it is best to keep the residual magnetic field around the granulated powders after demagnetization at less than 10G.

Further, by undercutting and overcutting using a sieve, it is possible to obtain granulated powders with exceptional flowability.

As well, by adding a small amount of lubricant such as zinc stearate, magnesium stearate, calcium stearate, aluminum stearate or polyethylene glycol, the flow characteristics can be further improved.

Now, as the granulated powders of this invention will be insulated by the binder mentioned below, and so will be difficult to oxidize in air, they also have the advantage of improved durability using the molding process.

Rare earth containing alloy powders

For the rare earth containing alloy powders used in this invention, any may be applied if they have an intrinsic anisotropicity, with R-Fe-B-type and R-Co-type alloy powders being most suitable.

In particular, one may use powders adjusted to the required composition by mixing powders formed from grinding an alloy of a single appropriate composition with powders formed by grinding alloys of differing compositions, adding additional elements to improve the coercive force and fabrication characteristics, these being well known rare earth containing alloy powders.

Any of the well known fabrication methods can used for the alloy powders such as dissolution and pulverization, quenching, direct reduction diffusion, hydrogen inclusion decay and atomizing, and although the particle size is not too limited, alloy powders with an average particle size of less than 1 μm are undesirable as they will react with oxygen in the air or water in the binder and be easily oxidized thus causing a possible reduction in the magnetic properties after sintering. Average particle sizes exceeding 10 μm are also undesirable as the powder particles will be too large and the sintered density saturates at about 95% with no possibility of being raised above this. Therefore, an average particle size in the range 1~10 μm is desirable with the range 1~6 μm being best.

Binder

As the rare earth containing alloy powders of this invention are in a slurry state, it is desirable to use an added binder consisting of water and a small amount of at least one of either methyl cellulose, polyacryl amide or polyvinyl alcohol. By adding a small amount of the above methyl cellulose, polyacryl amide or polyvinyl alcohol, we can improve the viscosity of the slurry while at the same time maintaining a strong binding force after drying, and, as only a small addition is sufficient, the residual oxygen and carbon within the powder can be reduced.

For the amount of binder included when using at least one of either methyl cellulose, polyacryl amide or polyvinyl alcohol independently, an amount of less than 0.05 wt % results in a weak binding force between the particles of the granulated powders and a remarkable reduction in their flowability as well as causing the granulated powders to break up when being supplied for molding, whereas if the amount exceeds 0.5 wt %, there will be an increase in the residual oxygen and carbon within the sintered product causing a loss of coercive force and a deterioration of magnetic properties. As such, an amount in the range 0.05~0.5 wt % is desirable.

Further, when using a combination of either methyl cellulose, polyacryl amide or polyvinyl alcohol, an amount in the range 0.05~0.4 wt % is desirable for the same reasons as those above.

For the amount of water to which a small amount of at least one of either methyl cellulose, polyacryl amide or polyvinyl alcohol is added, an amount of less than 20 wt % results in a high slurry concentration on mixing the binder with the alloy powder, meaning the viscosity will be too large, and as such, it is not possible to supply the said slurry from the stirrer described below to the spray dryer apparatus. Further, for an amount exceeding 50 wt %, the slurry concentration is too low and precipitation occurs within the stirrer and within the slurry supply pipe of the stirrer. This means that the slurry supply to the spray dryer machine will be unstable and the average particle size of the obtained granulated powders will be too small, and there will also be a dispersion among the particle sizes. As such, a range of 20~50 wt % is desirable.

Although there is no particular restriction on the water used, when using rare earth containing alloy powders, as we want to control the reaction with the rare earth components as much as possible, it is best to use pure water which has been deoxygenated, or water which has undergone a bubbling treatment with nitrogen or another inert gas.

Further, it is desirable to add and stir the binder to the alloy powder at a temperature in the range 0° C.~15° C., as we can control the oxidizing reaction between the alloy powder and the water. On the other hand, stirring at temperatures exceeding 15° C. promotes the oxidizing reaction between the alloy powder and the water, and is undesirable.

To maintain the temperature in the range 0° C.~15° C., cooling methods can be adopted such as cooling the stirring container with water cooled to the appropriate temperature.

Further, by adding at least one of the following dispersants or lubricants to the binder, such as glycerol, wax emulsion, stearic acid, phthalic acid ester, petriole, or glycol, or by adding a bubble suppressant such as n-octyl alcohol, polyalkylene derivatives or poly ether-type derivatives, the dispersability and uniformity is improved, as well as the powdering conditions within the spray dryer apparatus, and as such, it is possible to obtain spherical granulated powders with no air bubbles and exceptionally good slipperiness and flowability.

For the amount added, an amount of less than 0.03 wt % is not effective in improving the mold-releasing characteristics of the granulated powders after molding while an amount exceeding 0.3 wt % causes an increase in the residual oxygen and carbon content in the sintered product leading to a fall in the coercive force and a deterioration in the magnetic properties. As such, an addition of 0.03 wt %~0.3 wt % is desirable.

Fabrication process for sintered magnets

For the process of fabricating magnetically anisotropic sintered magnets using the anisotropic or isotropic granulated powders of this invention, that is, for the methods and conditions for molding, sintering and heat treating, previously known powder metallurgical methods can be used. Below, we give an example of favorable conditions for these methods.

For molding, although any known molding method can be adopted, compression molding is the most desirable, with a pressure of 0.3~2.0 Ton/cm$^2$ being best. Further, when applying a magnetic field when molding, a magnetic field strength in the range 10~20 kOe is desirable.

Before sintering, it is best to perform a treatment to remove the binder using the general method of heating under vacuum, or by raising the temperature by 100°~200° C. per hour under an atmosphere of flowing hydrogen, and then maintaining at 300°~600° C. for 1~2 hours. By instituting a treatment to remove the binder, almost all the carbon within the binder is removed, which is tied to the improvement in the magnetic properties.

Now, as alloy powders containing R elements will easily absorb hydrogen, it is best to perform a dehydrogation treatment after the treatment under flowing hydrogen to remove the binder. For the dehydrogation treatment, the temperature is raised at a rate of 50°~200° C. per hour under vacuum and maintained at between 500°~800° C. for 1~2 hours, thereby almost completely removing the absorbed hydrogen.

Further, after performing the dehydrogation treatment, it is best to perform sintering by successive temperature-controlled heating where one has the option after exceeding 500° C. to raise the temperature by, for example, a rate of 100°~300° C. per hour, and known temperature controlled methods can be used for sintering.

Conditions for the heat treatment during and after sintering of the molded product after removing the binder should be chosen according to the composition of the alloy powder. Thus, for the heat treatment conditions during and after sintering, a sintering process of maintaining at 1000°~1180° C. for 1~2 hours and an aging treatment of maintaining at 450°~800° C. for 1~8 hours are desirable.

Isotropic granulated powder and anisotropic sintered magnets

By using either the fabrication method for sintered magnets above, or the method shown below, it is possible to improve the flowability of the powder when molding and improve the magnetic properties of the obtained sintered magnets.

(1) When fabricating R-Fe-B-type sintered permanent magnets, it is normal that the shape and size of the secondary granulated powder particles after the spray dryer treatment are irregular. Thus, before adding the above binder to the R-Fe-B-type alloy powder and mixing to form a slurry, and granulating the said slurry by the spray dryer apparatus, the magnetic binding between the primary particles should be removed by demagnetizing the powders with a heat treatment (that is, thermal demagnetizing at a temperature 400°~700° C. above the Curie temperature). Then, by forming spherical liquid droplets only due to surface tension from water and the water soluble binder during spray atomizing, the granulated powders obtained by granulating secondary particles of an average size of 20 μm~400 μm will be spherical, and we can obtain exceptionally improved powder flowability when molding, without worsening the molded product density dispersion or reducing the life span of the molding machine. Thus, we can efficiently obtain anisotropic R-Fe-B-type sintered permanent magnets having exceptional dimensional precision after sintering, in thin film or small shape form with good magnetic properties.

The thermal demagnetization of the R-Fe-B-type alloy powders should be performed under vacuum or in an inert gas atmosphere, and because it is necessary for the treatment temperature to be a temperature higher than the Curie temperature (which differs by composition, but is almost always below 400° C.), it is best to perform this above 400° C. If the demagnetization treatment temperature exceeds 700° C., a phenomenon may occur depending on composition, whereby powder particles partially melt with each other, leading to a reduction in the flowability of the granulated powders after granulation and in the sintered density, and so this is undesirable. Therefore, it is best to use a demagnetization treatment temperature in the range 400° C.~700° C., where a range of 400° C.~500° C. is best.

(2) As a method to stabilize the powder characteristics of the granulated powders after spraying, when performing spray granulation using a slurry of R-Fe-B-type alloy powders which have been ground by wet microgrinding using water as a solvent, the mixing process after addition of the binder becomes unnecessary, which differs from the case of adding a water soluble binder to dry powder, and as such, the slurry can be processed before spraying in a short time by just the stirring process, and as the powder particles and the binder are more intimately mixed, the powder characteristics of the granulated powders after spraying are stabilized.

Further, for the water used in the wet microgrinding process using water as a solvent, pure water should be used containing less than a few ppm of chlorine, sodium, calcium and magnesium ions. By Using pure water where the dissolved oxygen content is less than I ppm after bubbling with an inert gas, and grinding under conditions where the water temperature is maintained at less than 15° C. under an inert gas atmosphere, the oxidization of the R-Fe- alloy powders can be controlled.

(3) After orientating the granulated powders, which were granulated from a slurry made by, adding the previously noted binder to R-Fe-B-type alloy powders and mixing, using a spray dryer apparatus, by applying a pulsed magnetic field before compression molding, which at the same time breaks up the primary powder particles, and then compression molding within a static magnetic field, sufficient orientation of the C-axis of the primary powder particles of the said granulated powder in the die can be obtained, where the binder itself helps to provide exceptional flowability, and so, we can efficiently obtain anisotropic R-Fe-B-type sintered magnets having exceptional dimensional precision after sintering, in thin film or small shape form with good magnetic properties.

(4) In order to control the reaction between the R component of the R-Fe-B-type magnetic powders with the binder and the water, instead of the required single composition R-Fe-B-type alloy raw powder generally used in traditional powder metallurgy, by Using two types of raw powders including, the main component alloy powder with an average size of 1~10 μm which has the $R_2Fe_{14}B$-phase as its main component, and a liquid phase-type compound powder which contains many rare earth elements such as Co, Fe and R intermetallic phases containing the $R_3Co$-phase, for example, the $R_2(FeCo)_{14}B$-phase, which have an average particle size of 8~40 μm, larger than the average size of the main component powder, and which reacts strongly with the organic binder, we can reduce the residual oxygen content in the sintered product.

Effective actions

By the fabrication method of this invention for isotropic granulated powders, we can efficiently obtain anisotropic R-Fe-B-type or R-Co-type sintered magnets having exceptional dimensional precision after sintering, in thin film or small shape form with good magnetic properties, by, adding a binder consisting of methyl cellulose, polyacryl amide, polyvinyl alcohol and water to rare earth containing alloy powders such as R-Fe-B-type or R-Co-type alloy powders and mixing to form a slurry, and granulating this slurry using a spray dryer apparatus, where the binder itself helps to provide exceptional flowability, greatly improving the flowability of the powder, and improving the molding cycle, while at the same time not worsening the dispersion of the molded product density or the life span of the molding equipment.

By the fabrication method of this invention for anisotropic granulated powders, we can fabricate powders having good magnetic properties by, stirring a slurry of rare earth containing alloy powders, and, while applying a magnetic field to orientate the said powder particles, forming orientated liquid droplets by spraying within the chamber of a spray dryer apparatus, followed by instantaneously dry solidifying them to form anisotropic granulated powders. Here, we can improve the lubrication and flow properties of the powder when compression molding in a magnetic field, improve the molding cycle and improve the dimensional precision of the molded product.

Further, by the fabrication method of this invention for anisotropic granulated powders, we can fabricate anisotropic magnetic powders unobtainable with previous spray dryer equipment, and as the flowability of the granulated powders thus obtained is also good for press molding, we need not worry about oxidization or carbonization. Also, we have presented fabrication equipment for anisotropic granulated powder most suitable to the granulation of materials which are difficult to mold, such as rare earth magnetic materials, and this equipment is most suitable for large scale mass production.

BRIEF DESCRIPTION OF THE DRAWINGS

FIG. 1 is a drawing showing an example of the rotary disk of the fabrication apparatus for granulated powders of this invention.

FIG. 2 is a drawing showing an example of a rotary disk whereby the disk of the fabrication apparatus for anisotropic granulated powders of this invention is completely constructed from an electromagnet.

FIG. 3 is a drawing showing an example of the placement of an electromagnet in the external environs of the raw slurry supply pipe for the fabrication apparatus for anisotropic granulated powders of this invention.

FIG. 4 is a drawing showing an example of the placement of an electromagnet surrounding the slurry supply shaft in the upper portion of the rotary disk of the fabrication apparatus for anisotropic granulated powders of this invention.

DETAILED DESCRIPTION OF PREFERRED EMBODIMENTS

We give a detailed explanation of the fabrication method of the anisotropic granulated powders of this invention based on diagrams. FIG. 1 is a sectional drawing showing the disk of the rotary disk-type spray dryer apparatus used in this invention.

The rotary disk 1 shown in FIG. 1, consists of opposing disks 2,2 separated by a fixed distance around the circumference by multiple pins 3, made of a non-magnetic material and of the required length, held in place by nuts 4, thus maintaining a fixed separation distance. This is a pin-type rotary disk constructed such that a rotating shaft 5 is placed in the center of the rotary disk 1, becoming the slurry supply outlet.

The rotary disk 1 is placed horizontally within a chamber with an airtight construction, which is not shown, to allow a rotating action, and a nozzle for the inert gas is placed at an appropriate position below the rotary disk i to allow spraying in an upward direction, while the lower portion of the chamber is the granulated powder collection section.

A slurry formed by adding the required binder to the magnetic powder and stirring is supplied to the said spray dryer apparatus from the slurry stirrer and is sprayed out by the centrifugal force of the rotary disk 1. The liquid droplets thus sprayed out are instantaneously dried by a flow of heated inert gas to form granulated powder, and fall naturally to the lower portion of the collection section.

Thus, after forming a slurry by adding a binder consisting of at least one of methyl cellulose, polyacryl amide or polyvinyl alcohol and water to R-Fe-B-type or R-Co-type alloy powders and mixing, the said slurry is formed into granulated powder by a spray dryer apparatus constructed as above, and we can efficiently obtain anisotropic R-Fe-B-type sintered magnets in thin film or small shape form with good magnetic properties and exceptional dimensional precision after sintering, where the binder itself helps to provide exceptional flowability, greatly improving the flowability of the powder, and improving the molding cycle, while at the same time not reducing the dispersion of the molded product density or the life span of the molding equipment.

The granulated powders of this invention will be by themselves isotropic, and as such, when molded without applying a magnetic field, isotropic molded products will of course be formed. If molding is performed while applying a magnetic field, the granulated powder will break up due to the actions of the compression force and the magnetic field and become the original primary particles, and as the said primary particles will be orientated by the magnetic field, anisotropic molded products will be obtained. As such, this method has the advantage of being able to fabricate either isotropic or anisotropic magnets depending on their use.

Further, as the granulated powders of this invention are insulated by the binder, they will not oxidize easily in air, and this method has the advantage that we can improve the operation of the molding process.

Next, for the apparatus in FIG. 1 in the explanation of the fabrication method for the anisotropic granulated powder of this invention, as the disk is totally constructed from a permanent magnet, we can fabricate anisotropic granulated powders.

That is, the rotary disk shown in FIG. 1 is now formed by two opposing disks 2,2 constructed from a disc wrapped in a soft magnetic metal, which is a rare earth permanent magnet magnetized in its thickist direction, and as above, a slurry formed by adding the required binder to the magnetic powder and stirring is supplied to the said spray dryer apparatus from the slurry stirrer. The slurry is sprayed out by the centrifugal force of the rotary disk 1, and as it is scattered out in a radiative form between the disks 2,2, the magnetic powder particles within the slurry are orientated by the magnetic field between disks 2,2, forming anisotropic granulated powders which are instantaneously dried by a flow of heated inert gas and fall naturally to the bottom of the collector section.

The rotary disk 10 shown in FIG. 2, is a pin-type rotary disk as in FIG. 1 whereby disks 11,11 are constructed from magnetic materials such as permalloy. Electromagnet coils 12,12 are placed horizontally around the upper portion of the rotary disk 10 and are magnetized when an electric current flows generating the required magnetic field, and when a slurry identical to that of the explanation of FIG. 1 is sprayed out by the centrifugal force of the rotary disk 10 and is scattered out in a radiative form between the disks 11,11, the magnetic powder particles within the slurry are orientated by the magnetic field between disks 11,11, and we can obtain anisotropic granulated powders.

Next, the example shown in FIG. 3 shows a construction whereby a magnetic field is applied close to the slurry supply pipe chamber which is a pipe running from the slurry stirrer to the spray dryer apparatus. By applying a magnetic field parallel to the orientation of the pipe, either by flowing a current through a coil 21 wrapped around the pipe 20, or by attaching a permanent magnet in the form of a ring, which is not shown, such that it is magnetized perpendicularly to the ring's surface, the most easily magnetized axis (C-axis) of the magnetic powder particles within the slurry within the pipe will be orientated parallel to the pipe.

When magnetic powder particles of a size of about 100 μm are orientated by a magnetic field, the magnetic attractive force of each primary particle will be extremely weak, and as they are hydrophobic, the composites formed when acted on by an external compression force will be relatively stable. These composites will be carried without breaking up until sprayed out by the rotary disk within the chamber, and the liquid droplets sprayed out from the rotary disk will be granulated while orientated by dry solidification to form anisotropic granulated powders.

The example shown in FIG. 4 shows a construction whereby a magnetic field is applied to a rotary shaft 5 which forms the slurry supply outlet in the upper portion of the rotary disk 30 within the chamber. The rotary disk 30, consists of disks 31,31 made from stainless steel and is a pin-type rotary disk as described above. By applying a magnetic field parallel to the orientation of the pipe, either by flowing an electric current through a coil 32 wrapped around the outside of the rotary shaft 5 at a position close to the disk 31, or by attaching a permanent magnet in the form of a ring, which is not shown, such that it is magnetized perpendicularly to the ring's surface, the most easily magnetized axis (C-axis) of the magnetic powder particles within the slurry in the pipe will be orientated parallel to the pipe.

Therefore, in principle, although this is identical to the method of applying a magnetic field to the pipe 20 in FIG. 3, the beneficial point of this construction is that, as the process from orientating the magnetic powder particles within the slurry to spraying them out is very short, the above primary particle composites do not break up easily, and are not easily influenced by the slurry supply rate, slurry concentration or magnetic field strength, and as such, the degree of orientation of the granulated powders after granulation is rather high and easy to stabilize.

In the constructions of either FIG. 3 or FIG. 4, when applying a magnetic field of greater than 2 kOe parallel to the supply pipe, the orientation of the primary particles of granulated powders even after spray granulation will be rather good and they form aligned secondary particles. However, when the field is applied perpendicular to the pipe, as the flow rate of the slurry within the pipe differs between the pipe walls and the center of the pipe, the orientations of the primary particles will be scattered and the degree of orientation shows a falling trend leading to a reduction in the magnetic properties after sintering.

The method of anisotropizing the granulated powder particles by applying a magnetic field to the slurry supply pipe, has the disadvantage of showing a small drop in the degree of orientation of the granulated powders compared to the method of applying a magnetic field to the slurry supply shaft of the rotary shaft and within the disks of the rotary disk, and only has the advantage that existing equipment may be used.

EXAMPLE

Example 1-1

Using raw materials consisting of 13.3 atomic % Nd, 0.31 atomic % Pr and 0.28 atomic % Dy for R, and 3.4 atomic % Co and 6.5 atomic % B, with the remaining proportion being Fe and some unavoidable impurities, an ingot alloy in button form was obtained using high frequency dissolution under an Ar atmosphere. Next, the said alloy, after coarse grinding, was ground to an average particle size of 15 μm by a jaw crusher, and a powder with an average particle size of 3 μm was then obtained by a jet mill.

A slurry was then formed by adding a binder, the type and quantity being shown in table 1-1a, water and lubricant to the said powder, and mixing at room temperature, and the said slurry was then granulated using a rotary disk-type spray dryer apparatus, with nitrogen as the inert gas and setting the heated gas flow entrance temperature to 100° C. and the exit temperature to 40° C.

Fine particles are then undercut from the obtained granulated powder by a #350 sieve, while coarse powders are overcut by a #70 sieve. The average particle size and yield from #350 to #70 are shown in table 1-1a.

After molding the above granulated powders into a form 10 mm×15 mm×10 mm thick using a compression press with a magnetic field strength of 15 kOe and a pressure of 1 ton/cm$^2$, a binder removal treatment was performed by controlled heating under a hydrogen atmosphere from room temperature to 300° C. at a rate of 100° C. per hour, followed immediately by sintering by raising the temperature to 1100° C. under vacuum and maintaining for one hour. When sintering was complete, an aging treatment was performed whereby Ar gas is introduced and the sintered product is cooled to 800° C. at a rate of 7° C. per minute, then cooled at a rate of 100° C. per hour and maintained at 550° C. for two hours. An anisotropic sintered product was thus obtained.

The flowability of the granulated powders when molding, the dimensions and density of the molded product and the residual oxygen and carbon content of the sintered magnets, as well as their magnetic properties are shown in No 1~7 of table 1-1b.

The flowability is measured as the time required for 100 g of raw powder to naturally fall through a funnel tube with a bore of 8 mm.

Finally, no breaks, cracks or warps were seen in any of the obtained sintered products.

Comparative example 1-1

A sintered magnet was obtained using the same 3 μm powder as example 1-1, without being granulated, whereby, after molding as is into a form 10 mm×15 mm×10 mm thick using the compression press of example 1-1 with a magnetic field strength of 15 kOe and a pressure of 1 ton/cm$^2$, sintering was performed by maintaining the sample at 1100° C. under vacuum for one hour, and when sintering was complete, an aging treatment was performed whereby Ar gas is introduced and the sintered product is cooled to 800° C. at a rate of 7° C. per minute, then cooled at a rate of 100° C. per hour and maintained at 550° C. for two hours.

The flowability of the powders when molding, the dimensions and density of the molded product and the residual oxygen and carbon content of the sintered magnets, as well as their magnetic properties are shown together with example 1-1 in No 8 of table 1-1b.

TABLE 1-1a

| | Binder | | | Lubricant | | | |
|---|---|---|---|---|---|---|---|
| No | Type | Amount added (wt %) | Amount of water included (wt %) | Type | Amount added (wt %) | Average particle size (μm) | Yield (%) |
| 1 | methyl cellulose | 0.15 | 35.0 | glycerol<br>stearic acid | 0.07<br>0.05 | 75 | 85 |
| 2 | methyl cellulose<br>polyacryl amide | 0.08<br>0.07 | 35.0 | glycerol<br>stearic acid | 0.07<br>0.05 | 82 | 88 |
| 3 | polyacryl amide | 0.15 | 35.0 | glycerol<br>stearic acid | 0.07<br>0.05 | 93 | 94 |
| 4 | polyvinyl alcohol | 0.15 | 35.0 | glycerol<br>stearic acid | 0.05<br>0.05 | 45 | 76 |
| 5 | polyvinyl alcohol<br>polyacryl amide | 0.08<br>0.07 | 35.0 | glycerol<br>stearic acid | 0.05<br>0.05 | 62 | 84 |
| 6 | methyl cellulose<br>polyvinyl alcohol | 0.08<br>0.07 | 35.0 | glycerol<br>stearic acid | 0.05<br>0.05 | 78 | 82 |
| 7 | methyl cellulose<br>polyacryl amide<br>polyvinyl alcohol | 0.05<br>0.05<br>0.05 | 35.0 | glycerol<br>stearic acid | 0.05<br>0.05 | 83 | 90 |

TABLE 1-1b

| | | Press characteristics (n = 20) | | Residual | Residual | Magnetic Characteristics | | |
|---|---|---|---|---|---|---|---|---|
| No | flowability (sec) | Thickness dimension (mm) | Density (g/cc) | oxygen content (ppm) | corbon content (ppm) | Br (kG) | iHc (kOe) | (BH)max (MGOe) |
| This invention | | | | | | | | |
| 1 | 37 | max:10.20<br>min:10.09 | max:4.40<br>min:4.32 | 6800 | 650 | 12.4 | 12.0 | 36.0 |
| 2 | 34 | max:10.15<br>min:10.03 | max:4.41<br>min:4.33 | 7000 | 630 | 12.3 | 11.9 | 35.7 |
| 3 | 28 | max:10.11<br>min:10.04 | max:4.39<br>min:4.34 | 7100 | 670 | 12.4 | 11.7 | 36.1 |
| 4 | 40 | max:10.21<br>min:10.03 | max:4.38<br>min:4.31 | 7300 | 740 | 12.3 | 13.1 | 35.1 |
| 5 | 38 | max:10.26<br>min:10.11 | max:4.41<br>min:4.32 | 7200 | 710 | 12.3 | 12.9 | 35.3 |
| 6 | 35 | max:10.24<br>min:10.15 | max:4.40<br>min:4.32 | 7000 | 650 | 12.4 | 12.1 | 35.8 |
| 7 | 33 | max:10.18<br>min:10.03 | max:4.43<br>min:4.35 | 7200 | 680 | 12.4 | 12.0 | 35.5 |

TABLE 1-1b-continued

| No | flowability (sec) | Press characteristics (n = 20) Thickness dimension (mm) | Density (g/cc) | Residual oxygen content (ppm) | Residual corbon content (ppm) | Magnetic Characteristics Br (kG) | iHc (kOe) | (BH)max (MGOe) |
|---|---|---|---|---|---|---|---|---|
| Comparative | | | | | | | | |
| 8 | no flow | max: 8.14 min: 4.72 | max:4.25 min:4.08 | 6500 | 580 | 12.4 | 12.8 | 37.7 |

Example 1-2

Using raw materials consisting of 11.9 atomic % Sm, 8.8 atomic % Cu, 12.6 atomic % Fe, and 1.2 atomic % Zn with the remaining proportion being Co and some unavoidable impurities, an ingot alloy in button form was obtained using high frequency dissolution under an Ar atmosphere. Next, the said alloy, after coarse grinding, was ground to an average particle size of 15 μm by a jaw crusher, and a powder with an average particle size of 3 μm was then obtained by a jet mill.

A slurry was then formed by adding a binder, the type and quantity being shown in table 1-2a, water and lubricant to the said powder, mixing and stirring at room temperature, and the said slurry was then granulated using a disk rotary-type spray dryer apparatus, with nitrogen as the inert gas and setting the heated gas flow entrance temperature to 100° C. and the exit temperature to 40° C.

After molding the above granulated powders into a form 10 mm×15 mm×10 mm thick using a compression press with a magnetic field strength of 15 kOe and a pressure of 1 ton/cm$^2$, a binder removal treatment was performed by controlled heating under a hydrogen atmosphere from room temperature to 300° C. at a rate of 100° C. per hour, followed immediately by sintering by raising the temperature to 1200° C. under vacuum and maintaining for one hour. When sintering was complete, a solution annealing treatment was performed at 1160° C. followed by the introduction of Ar gas and a multi-step aging treatment performed from 800° C. to 400° C.

The flowability of the powders when molding, the dimensions and density of the molded product and the residual oxygen and carbon content of the sintered magnets, as well as their magnetic properties are shown in No 10~16 of table 1-2b.

The flowability is measured as the time required for 100 g of raw powder to naturally fall through a funnel tube with a bore of 8 mm.

Finally, no breaks, cracks or warps were seen in any of the obtained sintered products.

Comparative example 1-2

A sintered magnet was obtained using the same 3 μm powder as example 1-2, without being granulated, whereby, after molding as is into a form 10 mm×15 mm×10 mm thick using the compression press of the above example with a magnetic field strength of 15 kOe and a pressure of 1 ton/cm$^2$, sintering was performed by maintaining the sample at 1200° C. under vacuum for one hour. When sintering was complete, a solution annealing treatment was performed at 1160° C. followed by the introduction of Ar gas and a multi-step aging treatment performed from 800° C. to 400° C.

The flowability of the powders when molding, the dimensions and density of the molded product and the residual oxygen and carbon content of the sintered magnets, as well as their magnetic properties are shown together with the above example in No 17 of table 1-2b.

As is clear from tables 1-1b and 1-2b, for spray granulation, the flowability of the powder is improved and the scatter in the dimensions and density is reduced. As well, the carbon content is almost the same as that for sintered products of powders not spray granulated, and does not destroy the magnetic properties, which is extremely desirable.

TABLE 1-2a

| No | Binder Type | Amount added (wt %) | Amount of water included (wt %) | Lubricant Type | Amount added (wt %) | Average particle size (μm) |
|---|---|---|---|---|---|---|
| This invention | | | | | | |
| 10 | methyl cellulose | 0.30 | 34 | glycerol<br>stearic acid | 0.05<br>0.05 | 62 |
| 11 | methyl cellulose<br>polyvinyl alcohol | 0.15<br>0.15 | 34 | glycerol<br>stearic acid | 0.07<br>0.05 | 54 |
| 12 | polyvinyl alcohol | 0.30 | 34 | glycerol<br>stearic acid | 0.05<br>0.05 | 48 |
| 13 | polyacryl amide | 0.30 | 38 | glycerol<br>stearic acid | 0.05<br>0.05 | 73 |

TABLE 1-2a-continued

| No | Binder Type | Binder Amount added (wt %) | Amount of water included (wt %) | Lubricant Type | Lubricant Amount added (wt %) | Average particle size (μm) |
|---|---|---|---|---|---|---|
| 14 | methyl cellulose | 0.15 | 36 | glycerol | 0.07 | 81 |
| | polyacryl amide | 0.15 | | stearic acid | 0.05 | |
| 15 | polyacryl amide | 0.15 | 36 | glycerol | 0.05 | 64 |
| | polyvinyl alcohol | 0.15 | | stearic acid | 0.05 | |
| 16 | methyl cellulose | 0.10 | 35 | glycerol | 0.05 | 67 |
| | polyacryl amide | 0.10 | | stearic acid | 0.05 | |
| | polyvinyl alcohol | 0.10 | | | | |

TABLE 1-2b

| No. | flowability (sec) | Press characteristics (n = 20) Thickness dimension (mm) | Press characteristics (n = 20) Density (g/cc) | Residual oxygen content (ppm) | Residual corbon content (ppm) | Magnetic Characteristics Br (kG) | Magnetic Characteristics iHc (kOe) | Magnetic Characteristics (BH)max (MGOe) |
|---|---|---|---|---|---|---|---|---|
| This invention | | | | | | | | |
| 10 | 39 | max:10.17<br>min: 9.93 | max:4.38<br>min:4.27 | 5300 | 440 | 9.4 | 8.3 | 21.0 |
| 11 | 42 | max:10.15<br>min: 9.92 | max:4.34<br>min:4.25 | 5600 | 510 | 9.5 | 7.5 | 21.4 |
| 12 | 45 | max:10.18<br>min: 9.90 | max:4.39<br>min:4.24 | 5800 | 540 | 9.5 | 7.3 | 21.2 |
| 13 | 34 | max:10.21<br>min:10.04 | max:4.41<br>min:4.32 | 5400 | 450 | 9.5 | 8.1 | 21.3 |
| 14 | 31 | max:10.20<br>min:10.08 | max:4.38<br>min:4.31 | 5400 | 480 | 9.5 | 8.0 | 21.2 |
| 15 | 38 | max:10.19<br>min: 9.95 | max:4.40<br>min:4.28 | 5600 | 500 | 9.5 | 7.6 | 21.3 |
| 16 | 37 | max:10.24<br>min:10.06 | max:4.35<br>min:4.22 | 5500 | 510 | 9.5 | 7.6 | 21.4 |
| Comparative | | | | | | | | |
| 17 | no flow | max: 7.52<br>min: 4.25 | max:4.28<br>min:4.11 | 5100 | 380 | 9.6 | 8.5 | 22.0 |

Example 1-3

Granulation was performed using the same 3 μm powder as example 1-1, by forming a slurry by adding a binder, the type and quantity being shown in table 1-3a, water and lubricant, stirring for five hours at the temperature shown in table 1-3a, and mixing, and then granulating using a disk rotary-type spray dryer apparatus, with nitrogen as the inert gas and setting the heated gas flow entrance temperature to 100° C. and the exit temperature to 40° C.

Fine particles were then undercut from the obtained granulated powder by a #350 sieve, while coarse powders were overcut by a #70 sieve. The average particle size and yield from #350 to #70 are shown in table 1-3a.

After molding the above granulated powders into a form 10 mm×15 mm×10 mm thick using a compression press with a magnetic field strength of 15 kOe and a pressure of 1 ton/cm$^2$, a binder removal treatment was performed by controlled heating under a hydrogen atmosphere from room temperature to 300° C. at a rate of 100° C. per hour, followed immediately by sintering by raising the temperature to 1100° C. under vacuum and maintaining for one hour. When sintering was complete, an aging treatment was performed whereby Ar gas is introduced and the sintered product is cooled to 800° C. at a rate of 7° C. per minute, then cooled at a rate of 100° C. per hour and maintained at 550° C. for two hours. An anisotropic sintered product was thus obtained.

The flowability of the powders when molding, the dimensions and density of the molded product and the residual oxygen and carbon content of the sintered magnets, as well as their magnetic properties are shown in No 18~21 of table 1-3b.

The flowability is measured as the time required for 100 g of raw powder to naturally fall through a funnel tube with a bore of 8 mm.

Finally, no breaks, cracks or warps were seen in any of the obtained sintered products.

As is clear from table 1-3b, the magnetic properties obtained for a slurry stirring temperature of less than 15° C. are much improved compared to a slurry stirring temperature of 20° C.

TABLE 1-3a

| No | Binder Type | Binder Amount added (wt %) | Amount of water included (wt %) | Lubricant Type | Lubricant Amount added (wt %) | Slurry stirring temperature (μm) | Average particle size (μm) | Yield (%) |
|---|---|---|---|---|---|---|---|---|
| 18 | polyvinyl alcohol | 0.15 | 35 | glycerol<br>stearic acid | 0.05<br>0.05 | 5 | 51 | 74 |
| 19 | polyvinyl alcohol | 0.15 | 35 | glycerol<br>stearic acid | 0.05<br>0.05 | 10 | 47 | 76 |
| 20 | polyvinyl alcohol | 0.15 | 35 | glycerol<br>stearic acid | 0.05<br>0.05 | 15 | 49 | 73 |
| 21 | polyvinyl alcohol | 0.15 | 35 | glycerol<br>stearic acid | 0.05<br>0.05 | 20 | 45 | 76 |

TABLE 1-3b

| No | flowability (sec) | Press characteristics (n = 20) Thickness dimension (mm) | Density (g/cc) | Residual oxygen content (ppm) | Residual corbon content (ppm) | Magnetic Characteristics Br (kG) | iHc (kOe) | (BH)max (MGOe) |
|---|---|---|---|---|---|---|---|---|
| This invention | | | | | | | | |
| 18 | 38 | max:10.25<br>min:10.04 | max:4.41<br>min:4.34 | 6800 | 650 | 12.4 | 14.1 | 36.5 |
| 19 | 39 | max:10.24<br>min:10.05 | max:4.38<br>min:4.32 | 6900 | 660 | 12.4 | 13.8 | 36.3 |
| 20 | 39 | max:10.20<br>min:10.00 | max:4.39<br>min:4.32 | 7100 | 680 | 12.3 | 13.5 | 36.0 |
| 21 | 40 | max:10.21<br>min:10.03 | max:4.38<br>min:4.31 | 7300 | 740 | 12.3 | 13.1 | 35.1 |

Example 2

Using raw materials consisting of 13.3 atomic % Nd, 0.31 atomic % Pr and 0.28 atomic % Dy for R, and 3.4 atomic % Co and 6.5 atomic % B, with the remaining proportion being Fe and some unavoidable impurities, an ingot alloy in button form was obtained using high frequency dissolution under an Ar atmosphere. Next, the said alloy, after coarse grinding, was ground to an average particle size of 15 μm by a jaw crusher, and a powder with an average particle size of 3 μm was then obtained by a jet mill.

A slurry was then formed by, demagnetizing the said powders under the thermal demagnetizing conditions listed in table 2a, adding a binder, the type and quantity also being shown in table 2a, water and lubricant to the said powder, and mixing at room temperature, and the said slurry was then granulated using a rotary disk rotary-type spray dryer apparatus, with nitrogen as the inert gas and setting the heated gas flow entrance temperature to 100° C. and the exit temperature to 40° C.

Fine particles were then undercut from the obtained granulated powder by a #350 sieve, while coarse powders were overcut by a #70 sieve, yielding granulated powders of an average particle size shown in table 2a.

After molding the said granulated powders into a form 10 mm×15 mm×10 mm thick using a compression press with a magnetic field strength of 15 kOe and a pressure of 1 ton/cm$^2$, a binder removal treatment was performed by controlled heating under a hydrogen atmosphere from room temperature to 300° C. at a rate of 100° C. per hour, followed immediately by sintering by raising the temperature to 1100° C. under vacuum and maintaining for one hour. When sintering was complete, an aging treatment was performed whereby Ar gas is introduced and the sintered product is cooled to 800° C. at a rate of 7° C. per minute, then cooled at a rate of 100° C. per hour and maintained at 550° C. for two hours. An anisotropic sintered product was thus obtained.

The flowability of the granulated powders when molding, the dimensions and density of the molded product and the residual oxygen and carbon content of the sintered magnets, as well as their magnetic properties are shown in table 2b.

The flowability is measured as the time required for 100 g of raw powder to naturally fall through a funnel tube with a bore of 8 mm.

Finally, no breaks, cracks or warps were seen in any of the obtained sintered products.

Comparative example 2

Granulation was performed using the raw powder of example 2 before thermal demagnetization, under the same conditions as No 1~4 of example 2. The processes following molding for the thus obtained granulated powders were performed under the same conditions as for example 2.

The flowability of the granulated powders when molding, the dimensions and density of the molded product and the residual oxygen and carbon content of the sintered magnets, as well as their magnetic properties are shown in No 9~12 of table 2b.

As is clear from the results shown in table 2b, the thermally demagnetized granulated powders all have an improved flowability compared to the undemagnetized granulated powders.

The reason for the greatly improved flowability of the thermally demagnetized granulated powders compared to the undemagnetized granulated powders is that the form of the secondary particles is close to spherical. As there will be no magnetic interaction between any of the powder particles due to the demagnetization process, it is likely that the liquid droplets solidify in a spherical form solely due to the surface tension of the water and binder.

TABLE 2a

| | Demagnetization conditions | | | Binder | | | Lubricant | | Average |
|---|---|---|---|---|---|---|---|---|---|
| | Heat treatment temperature | | | | | | | | |
| No. | Temperature (°C.) | Time (H) | Atmosphere | Type | Amount added (wt %) | Amount of water included (wt %) | Type | Amount added (wt %) | particle size after undercdutting and overcutting (μm) |
| This invention | | | | | | | | | |
| 2-1 | 400 | 1 | Vacuum | PVA | 0.15 | 35 | glycerol | 0.05 | 55 |
| | | | | | | | stearic acid | 0.05 | |
| 2-2 | " | " | " | MC | 0.15 | 35 | glycerol | 0.07 | 82 |
| | | | | | | | stearic acid | 0.05 | |
| 2-3 | " | " | " | PVA | 0.08 | 35 | glycerol | 0.05 | 68 |
| | | | | PAA | 0.07 | | stearic acid | 0.05 | |
| 2-4 | " | " | " | MC | 0.08 | 35 | glycerol | 0.07 | 93 |
| | | | | PAA | 0.07 | | stearic acid | 0.05 | |
| 2-5 | 700 | " | " | PVA | 0.20 | 35 | glycerol | 0.05 | 60 |
| | | | | | | | stearic acid | 0.05 | |
| 2-6 | 400 | " | " | PAA | 0.15 | 38 | glycerol | 0.05 | 87 |
| | | | | | | | stearic acid | 0.05 | |
| 2-7 | " | " | " | PVA | 0.08 | 35 | glycerol | 0.07 | 63 |
| | | | | MC | 0.07 | | stearic acid | 0.05 | |
| 2-8 | " | " | " | PVA | 0.05 | 36 | glycerol | 0.07 | 74 |
| | | | | MC | 0.05 | | stearic acid | 0.05 | |
| | | | | PAA | 0.05 | | | | |
| Comparative | | | | | | | | | |
| 2-9 | — | — | — | PVA | 0.15 | 35 | glycerol | 0.05 | 45 |
| | | | | | | | stearic acid | 0.05 | |
| 2-10 | — | — | — | MC | 0.15 | 35 | glycerol | 0.07 | 75 |
| | | | | | | | stearic acid | 0.05 | |
| 2-11 | — | — | — | PVA | 0.08 | 35 | glycerol | 0.05 | 62 |
| | | | | PAA | 0.07 | | stearic acid | 0.05 | |
| 2-12 | — | — | — | MC | 0.08 | 35 | glycerol | 0.07 | 82 |
| | | | | PAA | 0.07 | | stearic acid | 0.05 | |

TABLE 2b

| | | Press characteristics (n = 20) | | Residual O,C content after sintering | | Magnetic Characteristics | | |
|---|---|---|---|---|---|---|---|---|
| No. | flowability (sec) | Thickness dimension (mm) | Density (g/cc) | O (ppm) | C (ppm) | Br (kG) | iHc (kOe) | (BH)max (MGOe) |
| This invention | | | | | | | | |
| 2-1 | 26 | max:10.26 | max:4.39 | 7200 | 750 | 12.3 | 12.8 | 35.0 |
| | | min:10.18 | min:4.34 | | | | | |
| 2-2 | 23 | max:10.23 | max:4.41 | 6900 | 650 | 12.4 | 12.3 | 36.1 |
| | | min:10.14 | min:4.37 | | | | | |
| 2-3 | 24 | max:10.26 | max:4.40 | 7300 | 700 | 12.3 | 12.5 | 35.1 |
| | | min:10.19 | min:4.35 | | | | | |
| 2-4 | 21 | max:10.27 | max:4.41 | 7200 | 710 | 12.3 | 12.0 | 35.2 |
| | | min:10.18 | min:4.37 | | | | | |
| 2-5 | 25 | max:10.25 | max:4.40 | 7100 | 720 | 12.3 | 12.6 | 35.1 |
| | | min:10.17 | min:4.36 | | | | | |
| 2-6 | 22 | max:10.20 | max:4.40 | 7200 | 720 | 12.3 | 12.5 | 35.3 |
| | | min:10.14 | min:4.35 | | | | | |

TABLE 2b-continued

| No. | flowability (sec) | Press characteristics (n = 20) Thickness dimension (mm) | Density (g/cc) | Residual O,C content after sintering O (ppm) | C (ppm) | Magnetic Characteristics Br (kG) | iHc (kOe) | (BH)max (MGOe) |
|---|---|---|---|---|---|---|---|---|
| 2-7 | 25 | max:10.21 min:10.12 | max:4.38 min:4.33 | 7000 | 740 | 12.3 | 13.1 | 36.0 |
| 2-8 | 22 | max:10.25 min:10.17 | max:4.42 min:4.37 | 7100 | 730 | 12.3 | 12.6 | 35.8 |
| Comparative | | | | | | | | |
| 2-9 | 40 | max:10.21 min:10.03 | max:4.38 min:4.31 | 7300 | 740 | 12.3 | 13.1 | 35.1 |
| 2-10 | 37 | max:10.20 min:10.09 | max:4.40 min:4.32 | 6800 | 650 | 12.4 | 12.0 | 36.0 |
| 2-11 | 38 | max:10.26 min:10.11 | max:4.41 min:4.32 | 7200 | 710 | 12.3 | 12.9 | 35.3 |
| 2-12 | 34 | max:10.15 min:10.03 | max:4.41 min:4.33 | 7000 | 630 | 12.3 | 11.9 | 35.7 |

Example 3

Using raw materials consisting of 13.3 atomic % Nd, 0.31 atomic % Pr and 0.28 atomic % Dy for R, and 3.4 atomic % Co and 6.5 atomic % B, with the remaining proportion being Fe and some unavoidable impurities, an ingot alloy in button form was obtained using high frequency dissolution under an Ar atmosphere. Next, the said alloy, after coarse grinding, was ground to an average particle size of 20 μm by a jaw crusher.

After inserting these powders into a ball mill with an inner volume of 10 l, together with a steel ball of radius 8 mm, pure water at 5° C. was added to the ball mill where this water has an ionic including cationic and anionic concentration of less than 4 ppm and has had the dissolved oxygen content lowered to 0.8 ppm by bubbling with Ar gas.

After adding the water, fine grinding was performed by rotating for one hour at 120 rpm. The mill itself was cooled by a chiller so that the water temperature within the mill during grinding was less than 15° C. The average particle size after grinding was 4.3 μm.

A binder, the type and quantity being shown in table 3a, water and a lubricant were added to the said powder slurry and stirred in a stirring tank cooled to 10° C. The said slurry was then granulated using a rotary disk rotary-type spray dryer apparatus, with nitrogen as the inert gas and setting the heated gas flow entrance temperature to 100° C. and the exit temperature to 40° C.

After molding the said granulated powders into a form 10 mm×15 mm×10 mm thick using a magnetic compression press with a magnetic field strength of 15 kOe and a pressure of 1 ton/cm$^2$, a binder removal treatment was performed by controlled heating under a hydrogen atmosphere from room temperature to 300° C. at a rate of 100° C. per hour, followed immediately by sintering by raising the temperature to 1100° C. under vacuum and maintaining for one hour. When sintering was complete, an aging treatment was performed whereby Ar gas is introduced and the sintered product is cooled to 800° C. at a rate of 7° C. per minute, then cooled at a rate of 100° C. per hour and maintained at 550° C. for two hours. An anisotropic sintered product was thus obtained.

The flowability of the granulated powders when molding, the dimensions and density of the molded product and the residual oxygen and carbon content of the sintered magnets, as well as their magnetic properties are shown in No 1~7 of table 3b.

The flowability is measured as the time required for 100 g of raw powder to naturally fall through a funnel tube with a bore of 8 mm.

Finally, no breaks, cracks or warps were seen in any of the obtained sintered products.

Comparative example 3

After forming a slurry by, adding binder, water and lubricant, the amount of added water, binder and lubricant being shown in No 1~3 of table 3a, to powder obtained by grinding 20 μm coarse powder identical to that of example 3-1 to an average particle size of 3 μm by a jet mill, slurry granulation was performed on the said slurry under conditions identical to those for example 3. The processes following molding for the thus obtained granulated powders were performed under the same conditions as for example 3.

The average particle size of the granulated powder, the flowability of the granulated powders when molding, the dimensions and density of the molded product and the residual oxygen and carbon content after sintering are shown in No 8~10 of table 3b. The measurement methods here were the same as for example 3-1.

Finally, no breaks, cracks or warps were seen in any of the obtained sintered regions. As is clear from table 3b, the flowability of the powder of example 3 is much improved compared to that of comparative example 3.

TABLE 3a

| Binder No. | Binder Type | Binder Amount added (wt %) | Binder Amount of water included (wt %) | Lubricant Type | Lubricant Amount added (wt %) |
|---|---|---|---|---|---|
| This invention | | | | | |
| 1 | polyvinyl alcohol | 0.30 | 36 | glycerol | 0.05 |
| | | | | stearic acid | 0.05 |
| 2 | polyvinyl alcohol | 0.15 | 36 | glycerol | 0.07 |
| | methyl cellulose | 0,15 | | stearic acid | 0.05 |
| 3 | methyl cellulose | 0.30 | 36 | glycerol | 0.05 |
| | | | | stearic acid | 0.05 |
| 4 | polyacryl amide | 0.30 | 36 | glycerol | 0.05 |
| | | | | stearic acid | 0.05 |
| 5 | polyacryl amide | 0.15 | 36 | glycerol | 0.05 |
| | polyvinyl alcohol | 0.15 | | stearic acid | 0.05 |
| 6 | polyacryl amide | 0.15 | 36 | glycerol | 0.07 |
| | methyl cellulose | 0.15 | | stearic acid | 0.05 |
| 7 | polyacryl amide | 0.10 | 36 | glycerol | 0.05 |
| | methyl cellulose | 0.10 | | stearic acid | 0.05 |
| | polyvinyl alcohol | 0.10 | | | |

TABLE 3b

| No | Binder No | Average Particle size (μm) | flowability (sec) | Press characteristics (n = 20) Thickness dimension (mm) | Press characteristics (n = 20) Density (g/cc) | Residual oxygen content (ppm) | Residual corbon content (ppm) | Magnetic Characteristics Br (kG) | Magnetic Characteristics iHc (kOe) | Magnetic Characteristics (BH)max (MGOe) |
|---|---|---|---|---|---|---|---|---|---|---|
| This invention | | | | | | | | | | |
| 3-1 | 1 | 72 | 23 | max:10.23<br>min:10.18 | max:4.46<br>min:4.42 | 8100 | 830 | 12.3 | 13.4 | 35.4 |
| 3-2 | 2 | 83 | 21 | max:10.24<br>min:10.19 | max:4.45<br>min:4.41 | 8200 | 840 | 12.2 | 13.4 | 35.2 |
| 3-3 | 3 | 91 | 20 | max:10.22<br>min:10.17 | max:4.43<br>min:4.39 | 8200 | 820 | 12.2 | 13.5 | 35.1 |
| 3-4 | 4 | 98 | 18 | max:10.25<br>min:10.20 | max:4.43<br>min:4.38 | 8300 | 850 | 12.2 | 12.8 | 35.0 |
| 3-5 | 5 | 81 | 22 | max:10.23<br>min:10.17 | max:4.45<br>min:4.40 | 8200 | 840 | 12.2 | 13.2 | 35.1 |
| 3-6 | 6 | 76 | 19 | max:10.18<br>min:10.14 | max:4.41<br>min:4.37 | 8300 | 820 | 12.2 | 13.0 | 35.1 |
| 3-7 | 7 | 85 | 22 | max:10.14<br>min:10.08 | max:4.42<br>min:4.37 | 8200 | 830 | 12.2 | 13.4 | 35.3 |
| Comparative | | | | | | | | | | |
| 3-8 | 1 | 44 | 36 | max:10.18<br>min:10.05 | max:4.40<br>min:4.27 | 8000 | 810 | 12.3 | 13.1 | 35.9 |
| 3-9 | 2 | 56 | 34 | max:10.20<br>min:10.05 | max:4.42<br>min:4.26 | 8000 | 780 | 12.3 | 13.4 | 36.0 |
| 3-10 | 3 | 63 | 31 | max:10.24<br>min:10.13 | max:4.43<br>min:4.27 | 8200 | 800 | 12.3 | 13.2 | 35.8 |

Example 4

Using raw materials consisting of 13.3 atomic % Nd, 0.31 atomic % Pr and 0.28 atomic % Dy for R, and 3.4 atomic % Co and 6.5 atomic % B, with the remaining proportion being Fe and some unavoidable impurities, an ingot alloy in button form was obtained using high frequency dissolution under an Ar atmosphere. Next, the said alloy, after coarse grinding, was ground to an average particle size of 15 μm by a jaw crusher, and a powder with an average particle size of 3 μm was then obtained by a jet mill.

A slurry was then formed by adding a binder, the type and quantity being shown in table 4a, water and lubricant to the said powder, and mixing at room temperature, and the said slurry was then granulated using a rotary disk rotary-type spray dryer apparatus, with nitrogen as the inert gas and setting the heated gas flow entrance temperature to 100° C. and the exit temperature to 40° C.

After packing the said granulated powders into the die, a pulsed magnetic field of 30 kOe was applied to them, followed by compression molding under a static magnetic field of 10 kOe and at a pressure of 1 ton/cm$^2$ into a form 10 mm×15 mm×10 mm thick. A binder removal treatment was then performed by controlled heating under a hydrogen atmosphere from room temperature to 300° C. at a rate of 100° C. per hour, followed immediately by sintering by raising the temperature to 1100° C. under vacuum and maintaining for one hour. When sintering was complete, an aging treatment was performed whereby Ar gas is introduced and the sintered product is cooled to 800° C. at a rate of 7° C. per minute, then cooled at a rate of 100° C. per hour and maintained at 550° C. for two hours. An anisotropic sintered product was thus obtained.

The dimensions and density of the molded product and the residual oxygen and carbon content of the sintered magnets, as well as their magnetic properties are shown in No 1~7 of table 4b.

The flowability is measured as the time required for 100 g of raw powder to naturally fall through a funnel tube with a bore of 8 mm.

Finally, no breaks, cracks or warps were seen in any of the obtained sintered products.

Comparative example 4

The granulated powders of example 4 were compression molded into a form 10 mm×15 mm×10 mm thick under static magnetic fields of 10 kOe and 15 kOe and at a pressure of 1 ton/cm$^2$. The treatment conditions following molding were identical to those for example 1.

The residual oxygen and carbon content after sintering, as well as the magnetic properties are shown in No 8~10 of table 4b. Here, the measurement methods were identical to those for example 4.

Finally, no breaks, cracks or warps were seen in any of the obtained sintered products.

TABLE 4a

| | Binder | | | Lubricant | | |
|---|---|---|---|---|---|---|
| Binder No | Type | Amount added (wt %) | Amount of water included (wt %) | Type | Amount added (wt %) | Average particle size (μm) |
| This invention | | | | | | |
| 1 | methyl cellulose | 0.30 | 36 | glycerol | 0.05 | 55 |
| | | | | stearic acid | 0.05 | |
| 2 | methyl cellulose | 0.15 | 36 | glycerol | 0.07 | 67 |
| | polyvinyl alcohol | 0.15 | | stearic acid | 0.05 | |
| 3 | polyvinyl alcohol | 0.30 | 36 | glycerol | 0.05 | 82 |
| | | | | stearic acid | 0.05 | |
| 4 | polyacryl amide | 0.30 | 36 | glycerol | 0.05 | 88 |
| | | | | stearic acid | 0.05 | |
| 5 | polyacryl amide | 0.15 | 36 | glycerol | 0.07 | 74 |
| | methyl cellulose | 0.15 | | stearic acid | 0.05 | |
| 6 | polyacryl amide | 0.15 | 36 | glycerol | 0.05 | 85 |
| | polyvinyl alcohol | 0.15 | | stearic acid | 0.05 | |
| 7 | polyacryl amide | 0.10 | 36 | glycerol | 0.05 | 80 |
| | polyvinyl alcohol | 0.10 | | stearic acid | 0.05 | |
| | methyl cellulose | 0.10 | | | | |

TABLE 4b

| | | Molding magnetic fiile | | Press characteristics (n = 20) | | Residual | Residual | Magnetic Characteristics | | |
|---|---|---|---|---|---|---|---|---|---|---|
| No | Binder No | Pulse (kOe) | Static field (kOe) | Thickness dimension (mm) | Density (g/cc) | oxygen content (ppm) | corbon content (ppm) | Br (kG) | iHc (kOe) | (BH)max (MGOe) |
| This invention | | | | | | | | | | |
| 4-1 | 1 | 30 | 10 | max:10.21 | max:4.43 | 8300 | 860 | 12.6 | 12.4 | 37.4 |
| | | | | min:10.14 | min:4.39 | | | | | |
| 4-2 | 2 | 30 | 10 | max:10.22 | max:4.42 | 8400 | 850 | 12.5 | 12.3 | 37.2 |
| | | | | min:10.18 | min:4.39 | | | | | |
| 4-3 | 3 | 30 | 10 | max:10.21 | max:4.43 | 8200 | 840 | 12.5 | 12.8 | 37.1 |
| | | | | min:10.17 | min:4.38 | | | | | |
| 4-4 | 4 | 30 | 10 | max:10.20 | max:4.43 | 8500 | 870 | 12.5 | 12.7 | 37.0 |
| | | | | min:10.16 | min:4.39 | | | | | |
| 4-5 | 5 | 30 | 10 | max:10.18 | max:4.45 | 8400 | 860 | 12.5 | 12.9 | 37.2 |
| | | | | min:10.14 | min:4.40 | | | | | |
| 4-6 | 6 | 30 | 10 | max:10.20 | max:4.39 | 8300 | 840 | 12.6 | 12.1 | 37.4 |
| | | | | min:10.16 | min:4.35 | | | | | |
| 4-7 | 7 | 30 | 10 | max:10.22 | max:4.37 | 8300 | 850 | 12.6 | 12.2 | 37.5 |
| | | | | min:10.18 | min:4.38 | | | | | |

TABLE 4b-continued

| No | Binder No | Molding magnetic fiile Pulse (kOe) | Static field (kOe) | Press characteristics (n = 20) Thickness dimension (mm) | Density (g/cc) | Residual oxygen content (ppm) | Residual corbon content (ppm) | Magnetic Characteristics Br (kG) | iHc (kOe) | (BH)max (MGOe) |
|---|---|---|---|---|---|---|---|---|---|---|
| Comparative | | | | | | | | | | |
| 4-8 | 1 | 0 | 10 | max:10.22 min:10.15 | max:4.42 min:4.38 | 8400 | 860 | 12.2 | 13.5 | 34.5 |
| 4-9 | 2 | 0 | 15 | max:10.23 min:10.18 | max:4.41 min:4.36 | 8300 | 830 | 12.3 | 12.6 | 35.1 |
| 4-10 | 3 | 0 | 15 | max:10.24 min:10.17 | max:4.42 min:4.37 | 8100 | 820 | 12.3 | 13.2 | 35.3 |

Example 5-1

Using raw materials consisting of 13.3 atomic % Nd, 0.31 atomic % Pr, 0.28 atomic % Dy, 3.4 atomic % Co and 6.5 atomic % B, with the remaining proportion being Fe and some unavoidable impurities, an ingot alloy in button form was obtained using high frequency dissolution under an Ar atmosphere. Next, the said alloy, after coarse grinding, was ground to an average particle size of 15 μm by a jaw crusher, and a powder with an average particle size of 3 μm was then obtained by a jet mill.

A slurry was then formed by adding a binder, the type and quantity being shown in table 5a, water and lubricant to the said powder, and mixing at room temperature, and the said slurry was then granulated by the fabrication apparatus for anisotropic granulated powders of this invention, with nitrogen as the inert gas and setting the heated gas flow entrance temperature to 100° C. and the exit temperature to 40° C.

The rotary disk of the said apparatus, shown in FIG. 1, is a pin-type rotary disk constructed entirely from a R-Fe-B-type permanent magnet with a permalloy (Ni-Fe-type alloy) covering to protect the surface. Here, the magnetic field between the rotary disks 1,1 was 3.5 kOe.

Next, demagnetization of the obtained granulated powders was performed by placing them in a damped oscillating magnetic field with an initial greatest amplitude of 3 kOe. The residual magnetic field for the powders after demagnetization was 3.5G.

Fine particles were then undercut from the obtained demagnetized granulated powder by a #440 sieve, while coarse powders were overcut by a #70 sieve, yielding granulated powders of an average particle size shown in table 5-1a. Here, the yield of #440 to #70 was 72%.

After molding the said granulated powders into a form 10 mm×15 mm×10 mm thick using a compression with a magnetic field strength of 15 kOe and a pressure of 1 ton/cm$^2$, a binder removal treatment was performed by controlled heating under a hydrogen atmosphere from room temperature to 300° C. at a rate of 100° C. per hour, followed immediately by sintering by raising the temperature to 1100° C. under vacuum and maintaining for one hour. When sintering was complete, an aging treatment was performed whereby Ar gas is introduced and the sintered product is cooled to 800° C. at a rate of 7° C. per minute, then cooled at a rate of 100° C. per hour and maintained at 550° C. for two hours. An anisotropic sintered product was thus obtained.

The flowability of the granulated powders when molding, the dimensions and density of the molded product and the residual oxygen and carbon content of the sintered magnet, as well as its magnetic properties are shown in No 1 of table 5-1b.

The flowability is measured as the time required for 100 g of raw powder to naturally fall through a funnel tube with a bore of 8 mm.

Finally, no breaks, cracks or warps were seen the obtained sintered product.

Example 5-2

Anisotropic granulated powders were fabricated using a slurry identical to that of example 5-1 and under the same spray conditions, by orientating liquid droplets just before spraying over the lower disk, using a rotary disk (Fe-Ni-type permalloy) magnetized by an electromagnet as shown in FIG. 2, and instantaneously dry solidifying them in an orientated state. The magnetic field between the rotary disks was 3.2 kOe.

After demagnetizing the obtained powders under the same conditions as for example 5-1, overcutting and undercutting were performed using #70 and #440 meshes, yielding an average particle size shown in No 2 of table 5-1a. Here, the yield of #440 to #70 was 69%.

Molding and sintering of this granulated powder was performed under identical conditions to example 5-1, yielding anisotropic sintered products.

The flowability of the granulated powders, the dimensions and density of the molded product and the residual oxygen and carbon content of the sintered product, as well as its magnetic properties are shown in No 2 of table 5-1b.

Finally, no breaks, cracks or warps were seen the obtained sintered product.

Example 5-3

Using a raw slurry identical to that of example 5-1, spraying was performed under the same conditions as for example 5-1, whereby magnetic powder particles within the raw slurry within the raw slurry supply pipe (inner diameter 7F, outer diameter 10F), were orientated in directions parallel and perpendicular to the pipe by an electromagnet as shown in FIG. 3. The magnetic field in the central region of the pipe was 4.2 kOe when the field was applied parallel to the supply pipe, and 3.5 kOe when the field was applied perpendicular to the pipe.

After demagnetizing the obtained powders under the same conditions as for example 5-1, overcutting and undercutting were performed using #70 and #440 meshes, yielding an average particle size shown in No 2 of table 5-1a. Here, the yield of #440 to #70 was 70%. Molding and sintering of this granulated powder were performed under identical conditions to example 5-1, yielding anisotropic sintered products.

The flowability of the granulated powders when magnetized in directions parallel and perpendicular to the supply pipe, the dimensions and density of the molded product and the residual oxygen and carbon content of the sintered product, as well as its magnetic properties are shown in No 3 of table 5-1b.

Finally, no breaks, cracks or warps were seen the obtained sintered product.

Example 5-4

Anisotropic granulated powders were fabricated using a slurry identical to that of example 5-1 and under the same spray conditions, by magnetizing the slurry within the rotary shaft parallel to the shaft using either a permanent magnet or an electromagnet as shown in FIG. 4. The magnetic field in the center of the shaft was 2.7 kOe when using the permanent magnet and 3.8 kOe when using the electromagnet.

After demagnetizing the obtained powders under the same conditions as for example 1, overcutting and undercutting were performed using #70 and #440 meshes, yielding an average particle size shown in No 6 of table 5-1a. Here, the yield of #440 to #70 was respectively 71% (No 5) and 75% (No 6). Molding and sintering of this granulated powder were performed under identical conditions to example 5-1, yielding anisotropic sintered products.

The flowability of the granulated powders, the dimensions and density of the molded product and the residual oxygen and carbon content of the sintered product, as well as its magnetic properties are shown in No 5 and No 6 of table 5-1b.

Finally, no breaks, cracks or warps were seen the obtained sintered product.

Example 5-5

Granulation was performed using a slurry identical to that of example 5-1 and under the same spray conditions, by using a pin-type rotary disk constructed entirely from a R-Fe-B-type permanent magnet with a permalloy (Ni-Fe-type alloy) covering to protect the surface, as shown in FIG. 1, and orientating the slurry within the slurry supply pipe parallel to the pipe using a permanent magnet or electromagnet as shown in FIG. 3. The magnetic field between the rotary disks 1,1 was 3.5 kOe, and the magnetic field in the central portion of the slurry supply pipe was 3.2 kOe when using the permanent magnet and 4.2 kOe when using the electromagnet.

After demagnetizing each of the obtained granulated powders under the same conditions as for example 5-1, overcutting and undercutting were performed using #70 and #440 meshes, yielding an average particle size shown in No 7 and No 8 of table 5-1a. Here, the yield of #440~#70 was respectively 71% (No 7) and 75% (No 8).

Molding and sintering of this granulated powder were performed under identical conditions to example 5-1, yielding anisotropic sintered products.

The flowability of the granulated powders when molding, the dimensions and density of the molded product and the residual oxygen and carbon content of the sintered product, as well as its magnetic properties are shown in No 7 and No 8 of table 5-1b Finally, no breaks, cracks or warps were seen the obtained sintered product.

Example 5-6

Granulation was performed using a slurry identical to that of example 5-1 and under the same spray conditions, by using a pin-type rotary disk where the upper and lower disks were constructed from permalloy (Fe-Ni-type alloy) and magnetized by an electromagnet, as shown in FIG. 2, and orientating the slurry within the slurry supply pipe parallel to the pipe using a permanent magnet or electromagnet as shown in FIG. 3. The magnetic field between the rotary disks 1,1 was 3.2 kOe, and the magnetic field in the central portion of the slurry supply pipe was 3.2 kOe when using the permanent magnet and 4.2 kOe when using the electromagnet.

After demagnetizing each of the obtained granulated powders under the same conditions as for example 5-1, overcutting and undercutting were performed using #70 and #440 meshes, yielding an average particle size shown in No 9 and No 10 of table 5-1a. Here, the yield of #440~#70 was respectively 8% (No 9) and 73% (No 10).

Molding and sintering of this granulated powder were performed under identical conditions to example 5-1, yielding anisotropic sintered products.

The flowability of the granulated powders when molding, the dimensions and density of the molded product and the residual oxygen and carbon content of the sintered product, as well as its magnetic properties are shown in No 9 and No 10 of table 5-1b.

Finally, no breaks, cracks or warps were seen the obtained sintered product.

Example 5-7

Granulation was performed using a slurry identical to that of example 5-1 and under the same spray conditions, by using a pin-type rotary disk constructed entirely from a R-Fe-B-type permanent magnet with a permalloy (Ni-Fe-type alloy) covering to protect the surface, as shown in FIG. 1, and by orientating the slurry within the rotary shaft parallel to the shaft using a permanent magnet or electromagnet as shown in FIG. 4. The magnetic field between the disks 1,1 was 3.5 kOe, and the magnetic field in the central portion of the rotary shaft was 2.7 kOe when using a permanent magnet and 3.8 kOe when using an electromagnet.

After demagnetizing each of the obtained granulated powders under the same conditions as for example 5-1, overcutting and undercutting were performed using #70 and #440 meshes, yielding an average particle size shown in No 11 and No 12 of table 5-1a.

Here, the yield of #440~#70 was respectively 65% (No 11) and 70% (No 12).

Molding, sintering and the aging treatment for the above granulated powders were performed by identical methods to example 5-1, yielding anisotropic sintered products.

The flowability of the granulated powders when molding, the dimensions and density of the molded product and the residual oxygen and carbon content of the sintered product, as well as its magnetic properties are shown in No 11 and No 12 of table 5-1b.

Finally, no breaks, cracks or warps were seen the obtained sintered product.

Comparative example 5-1

Anisotropic sintered products were obtained using 3 μm powders identical to those of example 5-1, by performing as it is, without granulation, molding, sintering and an aging treatment (omitting the binder removal treatment) identical to example 1.

The flowability of the powders when molding, the dimensions and density of the molded product and the residual oxygen and carbon content of the sintered product, as well as its magnetic properties are shown in No 13 of table 5-1b.

As is clear from the measurement results of 5-1b, the flowability of the anisotropic granulated powders of this invention and the dimensional precision of their molded products are extremely good. Further, as we can obtain similar characteristics for the magnetic properties of the sintered products usually obtained by methods without granulation by the magnetic orientation method used here, we know that it is especially suitable for molding of thin films or small shapes which are difficult to mold using existing compression molding techniques.

TABLE 5a

| | Slurry orietation method 1 | | | Slurry orietation method 2 | | | Binder | | | Lubricant | | |
|---|---|---|---|---|---|---|---|---|---|---|---|---|
| No | Source of magnetic field | Position | Magnetic field direction | Source of magnetic field | Position | Magnetic field direction | Type | Amount added (wt %) | Amount of water included (wt %) | Type | Amount added (wt %) | Average particle size. |
| This invention | | | | | | | | | | | | |
| 5-1 | Permanent magnet | Rotary disk | Perpendicular to the disk surface | — | — | — | PVA<br>MC | 0.20<br>0.05 | 36.0 | glycerol<br>stearic acid | 0.05<br>0.05 | 54 |
| 5-2 | Electro magnet | Rotary disk | Perpendicular to the disk surface | — | — | — | PVA<br>MC | 0.20<br>0.05 | " | glycerol<br>stearic acid | 0.05<br>0.05 | 57 |
| 5-3 | Electro magnet | Slurry supply pipe | Parallel to the pipe | — | — | — | PVA<br>MC | 0.20<br>0.05 | " | glycerol<br>stearic acid | 0.05<br>0.05 | 51 |
| 5-4 | Electro magnet | Slurry supply pipe | Pierpendicular to the pipe | — | — | — | PVA<br>MC | 0.20<br>0.05 | " | glycerol<br>stearic acid | 0.05<br>0.05 | 51 |
| 5-5 | Electro magnet | Rotary shaft | Parallel to the shaft | — | — | — | PVA<br>MC | 0.20<br>0.05 | " | glycerol<br>stearic acid | 0.05<br>0.05 | 55 |
| 5-6 | Permanent magnet | Rotary shaft | Parallel to the shaft | — | — | — | PVA<br>MC | 0.20<br>0.05 | " | glycerol<br>stearic acid | 0.05<br>0.05 | 60 |
| 5-7 | Permanent magnet | Rotary disk | Perpendicular to the disk surface | Permanent magnet | Slurry supply pipe | Parallel to the pipe | PVA<br>MC | 0.20<br>0.05 | " | glycerol<br>stearic acid | 0.05<br>0.05 | 61 |
| 5-8 | Permanent magnet | Rotary disk | Perpendicular to the disk surface | Electro magnet | Slurry supply pipe | Parallel to the pipe | PVA<br>MC | 0.20<br>0.05 | " | glycerol<br>stearic acid | 0.05<br>0.05 | 53 |
| 5-9 | Electro magnet | Rotary disk | Perpendicular to the disk surface | Permanent magnet | Slurry supply pipe | Parallel to the pipe | PVA<br>MC | 0.20<br>0.05 | " | glycerol<br>stearic acid | 0.05<br>0.05 | 55 |
| 5-10 | Electro magnet | Rotary disk | Perpendicular to the disk surface | Electro magnet | Slurry supply pipe | Parallel to the pipe | PVA<br>MC | 0.20<br>0.05 | " | glycerol<br>stearic acid | 0.05<br>0.05 | 58 |
| 5-11 | Permanent magnet | Rotary disk | Perpendicular to the disk surface | Permanent magnet | Rotary shaft | Parallel to the shaft | PVA<br>MC | 0.20<br>0.05 | " | glycerol<br>stearic acid | 0.05<br>0.05 | 54 |
| 5-12 | Permanent magnet | Rotary disk | Perpendicular to the disk surface | Electro magnet | Rotary shaft | Parallel to the shaft | PVA<br>MC | 0.20<br>0.05 | " | glycerol<br>stearic acid | 0.05<br>0.05 | 58 |

TABLE 5b

| | | Press characteristics (n = 20) | | | | Magnetic characteristics | | | |
|---|---|---|---|---|---|---|---|---|---|
| No | Flowability (sec) | Thickness dimension (mm) | Density (g/cc) | Residual oxygen (ppm) | Residual carbon (ppm) | Bs (kG) | Br (kG) | iHc (kOe) | (BH)max (MGOe) |
| This invention | | | | | | | | | |
| 5-1 | 41 | max:10.25<br>min:10.13 | max:4.44<br>min:4.37 | 7300 | 690 | 12.6 | 12.5 | 13.2 | 37.2 |
| 5-2 | 40 | max:10.22<br>min:10.13 | max:4.42<br>min:4.35 | 7300 | 690 | 12.6 | 12.5 | 13.0 | 37.1 |
| 5-3 | 42 | max:10.24<br>min:10.15 | max:4.44<br>min:4.34 | 7200 | 650 | 12.6 | 12.2 | 12.8 | 35.3 |
| 5-4 | 42 | max:10.23 | max:4.42 | 7300 | 680 | 12.6 | 10.8 | 13.5 | 27.1 |

TABLE 5b-continued

| No | Flowability (sec) | Press characteristics (n = 20) Thickness dimension (mm) | Density (g/cc) | Residual oxygen (ppm) | Residual carbon (ppm) | Magnetic characteristics Bs (kG) | Br (kG) | iHc (kOe) | (BH)max (MGOe) |
|---|---|---|---|---|---|---|---|---|---|
| 5-5 | 41 | min:10.14 max:10.22 | min:4.33 max:4.44 | 7300 | 680 | 12.6 | 12.3 | 13.0 | 36.0 |
| 5-6 | 40 | min:10.14 max:10.25 | min:4.32 max:4.45 | 7400 | 670 | 12.6 | 12.5 | 13.5 | 37.3 |
| 5-7 | 39 | min:10.14 max:10.22 | min:4.38 max:4.43 | 7400 | 650 | 12.6 | 12.5 | 12.8 | 37.5 |
| 5-8 | 41 | min:10.13 max:10.18 | min:4.35 max:4.41 | 7300 | 670 | 12.6 | 12.5 | 12.5 | 37.6 |
| 5-9 | 40 | min:10.10 max:10.25 | min:4.36 max:4.45 | 7300 | 660 | 12.6 | 12.5 | 12.1 | 37.5 |
| 5-10 | 41 | min:10.11 max:10.26 | min:4.37 max:4.43 | 7400 | 680 | 12.6 | 12.5 | 12.6 | 37.4 |
| 5-11 | 40 | min:10.15 max:10.13 | min:4.32 max:4.46 | 7300 | 680 | 12.6 | 12.5 | 13.1 | 38.1 |
| 5-12 | 41 | min:10.04 max:10.23 | min:4.38 max:4.43 | 7400 | 690 | 12.6 | 12.5 | 13.0 | 38.0 |
| Comparative | | min:10.12 | min:4.34 | | | | | | |
| 5-13 | no flow | max: 8.14 min: 4.72 | max:4.25 min:4.08 | 6500 | 580 | 12.6 | 12.4 | 12.8 | 37.7 |

Example 5-8

Using raw materials consisting of 11.9 atomic % Sm, 8.8 atomic % Cu, 12.6 atomic % Fe, and 1.2 atomic % Zn with the remaining proportion being Co and some unavoidable impurities, an ingot alloy in button form was obtained using high frequency dissolution under an Ar atmosphere. Next, the said alloy, after coarse grinding, was ground to an average particle size of 15 μm by a jaw crusher, and a powder with an average particle size of 3 μm was then obtained by a jet mill.

A slurry was then formed by adding a binder, the type being shown in table 5-2a, and lubricant to the said powder and mixing at room temperature, and the said slurry was then granulated by the fabrication methods for anisotropic granulated powders of this invention, with nitrogen as the inert gas and setting the heated gas flow entrance temperature to 100° C. and the exit temperature to 40° C.

The rotary disk used for the fabrication of anisotropic granulated powders was a pin-type rotary disk constructed entirely from a R-Fe-B-type permanent magnet with a permalloy (Ni-Fe-type alloy) covering to protect the surface, as shown in FIG. 1. Here, the magnetic field between the disks 1,1 was 3.5 kOe.

Next, demagnetization of the obtained granulated powders was performed by placing them in a damped oscillating magnetic field with an initial greatest amplitude of 3 kOe. The residual magnetic field for the powders after demagnetization was 4.1G.

Fine particles were then undercut from the demagnetized granulated powder by a #440 mesh, while coarse powders were overcut by a #70 mesh, yielding granulated powders of an average particle size shown in No 14 of table 5-2. Here, the yield of #440~#70 was 75%.

After molding the above granulated powders into a form 10 mm×15 mm×10 mm thick using a compression with a magnetic field strength of 15 kOe and a pressure of 1 ton/cm$^2$, a binder removal treatment was performed by controlled heating under a hydrogen atmosphere from room temperature to 300° C. at a rate of 100° C. per hour, followed immediately by sintering by raising the temperature to 1200° C. under vacuum and maintaining for one hour. When sintering was complete, a solution annealing treatment was performed at 1160° C. followed by the introduction of Ar gas and a multi-step aging treatment performed from 800° C. to 400° C. Anisotropic sintered products are thus obtained.

The flowability of the granulated powders when molding, the dimensions and density of the molded product and the residual oxygen and carbon content of the sintered product after sintering, as well as its magnetic properties are shown in No 14 of table 5-2b.

The flowability is measured as the time required for 100 g of raw powder to naturally fall through a funnel tube with a bore of 8 mm.

Finally, no breaks, cracks or warps were seen the obtained sintered product.

Example 5-9

Granulation was performed using a slurry identical to that of example 5-8 and under the same spray conditions, by orientating the slurry within the slurry supply pipe parallel to the pipe using a permanent magnet, as shown in FIG. 4. Here, The magnetic field in the central portion of the slurry supply pipe was 4.2 kOe.

After demagnetizing the obtained granulated powders under the same conditions as for example 5-8, overcutting and undercuttin were performed using #70 and #440 meshes, yielding an average particle size shown in No 15 of table 5-2a. Here, the yield of #440~#70 was 76%.

Molding, sintering and the aging treatment for the above granulated powders were performed by identical methods to example 5-8, yielding anisotropic sintered products.

The flowability of the granulated powders when molding, the dimensions and density of the molded product and the residual oxygen and carbon content of the sintered product after sintering, as well as its magnetic properties are shown in No 15 of table 5-2b.

Finally, no breaks, cracks or warps were seen the obtained sintered product.

Example 5-10

Granulation was performed using a slurry identical to that of example 5-8 and under the same spray conditions as example 5-1, using a pin-type rotary disk constructed entirely from a R-Fe-B-type permanent magnet with a permalloy (Ni-Fe-type alloy) covering to protect the surface, as shown in FIG. 1, and by orientating the slurry within the slurry supply pipe parallel to the pipe using a permanent magnet, as shown in FIG. 3. Here, the magnetic field between the disks 1,1 was 3.5 kOe, and the magnetic field in the central portion of the slurry supply pipe was 4.2 kOe.

After demagnetizing each of the obtained granulated powders under the same conditions as for example 5-8, overcutting and undercutting was performed using #70 and #440 meshes, yielding an average particle size shown in No 16 of table 5-2a. Here, the yield of #440~#70 was 63%.

Molding, sintering and the aging treatment for the above granulated powders were performed by identical methods to example 5-8, yielding anisotropic sintered products.

The flowability of the granulated powders when molding, the dimensions and density of the molded product and the residual oxygen and carbon content of the sintered product after sintering, as well as its magnetic properties are shown in No 16 of table 5-2b.

Finally, no breaks, cracks or warps were seen the obtained sintered product.

Comparative example 5-2

Anisotropic sintered products were obtained using 3 μm powders identical to those of example 5-8, by performing as it is, without granulation, molding, sintering and an aging treatment (omitting the binder removal treatment) identical to example 5-8.

The flowability of the powders when molding, the dimensions and density of the molded product and the residual oxygen and carbon content of the sintered product, as well as its magnetic properties are shown in No 17 of table 5-2b.

As is clear from the measurement results of 5-2b, the flowability of the anisotropic granulated powders of this invention and the dimensional precision of their molded products are extremely good. Further, as we can obtain similar characteristics for the magnetic properties of the sintered products usually obtained by methods without granulation by the magnetic orientation method used here, we know that it is especially suitable for molding of thin films or small shapes which are difficult to mold using existing compression molding techniques.

TABLE 5-2a

| | Slurry orietation method 1 | | | Slurry orietation method 2 | | | Binder | | | Lubricant | | |
|---|---|---|---|---|---|---|---|---|---|---|---|---|
| No. | Source of magnetic field | Position | Magnetic field direction | Source of magnetic field | Position | Magnetic field direction | Type | Amount added (wt %) | Amount of water included (wt %) | Type | Amount added (wt %) | Average particle size |
| This invention | | | | | | | | | | | | |
| 5-14 | Permanent magnet | Rotary disk | Perpendicular to the disk surface | — | — | — | PVA<br>MC | 0.20<br>0.05 | 33.0 | glycerol<br>stearic acid | 0.05<br>0.05 | 73 |
| 5-15 | Permanent magnet | Slurry supply pipe | Parallel to the pipe | — | — | — | PVA<br>MC | 0.20<br>0.05 | " | glycerol<br>stearic acid | 0.05<br>0.05 | 68 |
| 5-16 | Permanent magnet | Rotary disk | Perpendicular to the disk surface | Permanent magnet | Slurry supply pipe | Parallel to the pipe | PVA<br>MC | 0.20<br>0.05 | " | glycerol<br>stearic acid | 0.05<br>0.05 | 70 |

TABLE 5-2b

| | | Press characteristics (n = 20) | | | | Magnetic characteristics | | | |
|---|---|---|---|---|---|---|---|---|---|
| No | Flowability (sec) | Thickness dimension (mm) | Density (g/cc) | Residual oxygen (ppm) | Residual carbon (ppm) | Bs (kG) | Br (kG) | iHc (kOe) | (BH)max (MGOe) |
| This invention | | | | | | | | | |
| 5-14 | 36 | max:10.25<br>min:10.14 | max:4.63<br>min:4.54 | 6200 | 570 | 9.6 | 9.5 | 12.2 | 21.5 |
| 5-15 | 38 | max:10.22<br>min:10.12 | max:4.60<br>min:4.51 | 6000 | 540 | 9.6 | 9.5 | 11.3 | 21.0 |

TABLE 5-2b-continued

| No | Flowability (sec) | Press characteristics (n = 20) Thickness dimension (mm) | Density (g/cc) | Residual oxygen (ppm) | Residual carbon (ppm) | Magnetic characteristics Bs (kG) | Br (kG) | iHc (kOe) | (BH)max (MGOe) |
|---|---|---|---|---|---|---|---|---|---|
| 5-16 | 37 | max:10.24 min:10.14 | max:4.63 min:4.51 | 6100 | 560 | 9.6 | 9.5 | 12.1 | 21.8 |
| Comparative | | | | | | | | | |
| 5-17 | no flow | max: 7.25 min: 4.53 | max:4.67 min:4.54 | 5200 | 410 | 9.7 | 9.6 | 13.5 | 23.1 |

Example 5-11

Using raw materials consisting of 13.3 atomic % Nd, 0.31 atomic % Pr, 0.28 atomic % Dy, 3.4 atomic % Co and 6.5 atomic % B, with the remaining proportion being Fe and some unavoidable impurities, an ingot alloy in button form was obtained using high frequency dissolution under an Ar atmosphere. Next, the said alloy, after coarse grinding, was ground to an average particle size of 15 μm by a jaw crusher, and a powder with an average particle size of 3 μm was then obtained by a jet mill.

A slurry was then formed by adding a binder, the type being shown in table 5-3a, and lubricant to the said powder and mixing at room temperature, and the said slurry was then granulated by the fabrication methods for anisotropic granulated powders of this invention, with nitrogen as the inert gas and setting the heated gas flow entrance temperature to 100° C. and the exit temperature to 40° C.

The rotary disk used for the fabrication of anisotropic granulated powders was a pin-type rotary disk constructed entirely from a R-Fe-B-type permanent magnet with a permalloy (Ni-Fe-type alloy) covering to protect the surface, as shown in FIG. 1. Here, the magnetic field between the disks 1,1 was 3.5 kOe.

Next, demagnetization of each of the obtained granulated powders was performed by placing them in a damped oscillating magnetic field with an initial greatest amplitude of 3 kOe, and fine particles were then undercut from the demagnetized granulated powder by a #440 mesh, while coarse powders were overcut by a #70 mesh. The average particle size of each of the granulated powders and the yield of #440~#70 are shown in table 5-3.

After molding the said granulated powders into a form 10 mm×15 mm×10 mm thick using a compression with a magnetic field strength of 15 kOe and a pressure of 1 ton/cm$^2$, a binder removal treatment was performed by controlled heating under a hydrogen atmosphere from room temperature to 300° C. at a rate of 100° C. per hour, followed immediately by sintering by raising the temperature to 1100° C. under vacuum and maintaining for one hour. When sintering was complete, an aging treatment was performed whereby Ar gas is introduced and the sintered product is cooled to 800° C. at a rate of 7° C. per minute, then cooled at a rate of 100° C. per hour and maintained at 550° C. for two hours. An anisotropic sintered product was thus obtained.

The flowability of the granulated powders when molding, the dimensions and density of the molded product and the residual oxygen and carbon content of the sintered product after sintering, as well as its magnetic properties are shown in table 5-3.

The flowability was measured in an identical way to that of example 5-3.

Finally, no breaks, cracks or warps were seen the obtained sintered product.

Example 5-12

Using the same 3 μm powder as for example 5-11, a slurry was formed by adding binder, the type being shown in table 5-4, and lubricant and mixing at room temperature, and the slurry was granulated under the same conditions as for example 5-11 by the fabrication methods for anisotropic granulated powders of this invention.

The disk used for the fabrication method for anisotropic granulated powders was a pin-type rotary disk constructed entirely from a R-Fe-B-type permanent magnet with a permalloy (Ni-Fe-type alloy) covering to protect the surface, as shown in FIG. 1, and granulation was performed by orientating the slurry within the slurry supply pipe parallel to the pipe using a permanent magnet, as shown in FIG. 3. Here, the magnetic field between the disks 1,1 was 3.5 kOe, and the magnetic field in the central portion of the slurry supply pipe was 4.2 kOe.

After demagnetizing each of the obtained granulated powders under the same conditions as for example 5-11, overcutting and undercutting were performed using #70 and #440 meshes. The average particle size of each of the granulated powders and the yield of #440~#70 are shown in table 5-4.

Molding, sintering and the aging treatment for the above granulated powders were performed by identical methods to example 5-11, yielding anisotropic sintered products.

The flowability of the granulated powders when molding, the dimensions and density of the molded product and the residual oxygen and carbon content of the sintered product after sintering, as well as its magnetic properties are shown in table 5-4.

The flowability was measured in an identical way to that of example 5-1.

Finally, no breaks, cracks or warps were seen in any of the obtained sintered products.

TABLE 5-3

| No | Binder Type※ | Binder Amount added (wt %) | Amount of water included (wt %) | Lubricant Type | Lubricant Amount added (wt %) | Average particle size. (μm) | Yield (%) | Fowability (sec) |
|---|---|---|---|---|---|---|---|---|
| This invention | | | | | | | | |
| 5-18 | MC | 0.15 | 38.0 | glycerol<br>stearic acid | 0.07<br>0.05 | 65 | 81 | 35 |
| 5-19 | MC<br>PAA | 0.07<br>0.08 | " | glycerol<br>stearic acid | 0.07<br>0.05 | 73 | 85 | 32 |
| 5-20 | PAA | 0.15 | " | glycerol<br>stearic acid | 0.07<br>0.05 | 84 | 87 | 26 |
| 5-21 | PVA<br>MC | 0.20<br>0.05 | 36.0 | glycerol<br>stearic acid | 0.05<br>0.05 | 54 | 72 | 41 |
| 5-22 | PVA | 0.20 | 35.0 | glycerol<br>stearic acid | 0.05<br>0.05 | 41 | 68 | 43 |
| 5-32 | PVA<br>PAA | 0.10<br>0.05 | " | glycerol<br>stearic acid | 0.05<br>0.05 | 55 | 82 | 40 |
| 5-42 | MC<br>PAA<br>PVA | 0.10<br>0.05<br>0.10 | 35.0 | glycerol<br>stearic acid | 0.05<br>0.05 | 78 | 86 | 32 |

| No | Press characteristics (n = 20) Thicknessd imension (mm) | Density (g/cc) | Residual oxygen (ppm) | Residual cargon (ppm) | Magnetic characteristics Bs (kG) | Br (kG) | iHc (kOe) | (BH)Max (MGOe) |
|---|---|---|---|---|---|---|---|---|
| This invention | | | | | | | | |
| 5-18 | max:10.21<br>min:10.11 | max:4.43<br>min:4.35 | 6700 | 630 | 12.6 | 12.5 | 12.1 | 37.2 |
| 5-19 | max:10.14<br>min:10.05 | max:4.42<br>min:4,34 | 7100 | 650 | 12.6 | 12.5 | 11.5 | 37.2 |
| 5-20 | max:10.13<br>min:10.03 | max:4.40<br>min:4,31 | 7200 | 670 | 12.6 | 12.5 | 11.8 | 37.4 |
| 5-21 | max:10.25<br>min:10.13 | max:4.44<br>min:4.37 | 7300 | 690 | 12.6 | 12.5 | 13.2 | 37.2 |
| 5-22 | max:10.25<br>min:10.01 | max:4.41<br>min:4.28 | 7400 | 750 | 12.6 | 12.5 | 12.0 | 37.0 |
| 5-32 | max:10.24<br>min:10.04 | max:4.43<br>min:4.25 | 7200 | 700 | 12.6 | 12.5 | 12.1 | 37.2 |
| 5-42 | max:10.31<br>min:10.22 | max:4.43<br>min:4.35 | 7400 | 700 | 12.6 | 12.5 | 13.0 | 37.3 |

※For the binder type,
MC represents methyl cellulose,
PAA represents polyacryl amide and
PVA represents polyvinyl alcohol.

TABLE 5-4

| No | Binder Type※ | Binder Amount added (wt %) | Amount of water included (wt %) | Lubricant Type | Lubricant Amount added (wt %) | Average particle size (μm) | Yield (%) | Fowability (sec) |
|---|---|---|---|---|---|---|---|---|
| This invention | | | | | | | | |
| 5-25 | MC | 0.15 | 38.0 | glycerol<br>stearic | 0.07<br>0.05 | 65 | 80 | 34 |

TABLE 5-4-continued

| | | | | | | | | |
|---|---|---|---|---|---|---|---|---|
| | | | | acid | | | | |
| 5-26 | PAA | 0.15 | 38.0 | glycerol | 0.07 | 87 | 88 | 28 |
| | | | | stearic | 0.05 | | | |
| | | | | acid | | | | |
| 5-27 | PVA | 0.15 | 35.0 | glycerol | 0.05 | 45 | 71 | 41 |
| | | | | stearic | 0.05 | | | |
| | | | | acid | | | | |
| 5-28 | MC | 0.07 | 38.0 | glycerol | 0.07 | 75 | 84 | 40 |
| | PAA | 0.08 | | stearic | 0.05 | | | |
| | | | | acid | | | | |
| 5-29 | PVA | 0.20 | 36.0 | glycerol | 0.05 | 61 | 71 | 39 |
| | MC | 0.05 | | stearic | 0.05 | | | |
| | | | | acid | | | | |
| 5-30 | PVA | 0.10 | 35.0 | glycerol | 0.05 | 67 | 84 | 38 |
| | PAA | 0.05 | | stearic | 0.05 | | | |
| | | | | acid | | | | |
| 5-31 | MC | 0.10 | 35.0 | glycerol | 0.05 | 74 | 76 | 31 |
| | PAA | 0.05 | | stearic | 0.05 | | | |
| | PVA | 0.10 | | acid | | | | |

| | Press characteristics (n = 20) | | | | | | | |
|---|---|---|---|---|---|---|---|---|
| | Thickness | | Residual | Residual | Magnetic characteristics | | | |
| No | dimension (mm) | Density (g/cc) | oxygen (ppm) | carbon (ppm) | Bs (kG) | Br (kG) | iHc (kOe) | (BH)Max (MGOe) |
| This invention | | | | | | | | |
| 5-25 | max:10.11 min:10.02 | max:4.45 min:4.35 | 6800 | 640 | 12.6 | 12.5 | 12.0 | 38.1 |
| 5-26 | max:10.21 min:10.11 | max:4.40 min:4.32 | 7000 | 670 | 12.6 | 12.5 | 11.5 | 38.0 |
| 5-27 | max:10.15 min:10.06 | max:4.42 min:4.31 | 7200 | 700 | 12.6 | 12.5 | 12.1 | 37.9 |
| 5-28 | max:10.24 min:10.10 | max:4.42 min:4.32 | 7100 | 640 | 12.6 | 12.5 | 12.0 | 38.1 |
| 5-29 | max:10.22 min:10.13 | max:4.43 min:4.35 | 7400 | 650 | 12.6 | 12.5 | 12.8 | 37.5 |
| 5-30 | max:10.30 min:10.21 | max:4.44 min:4.36 | 7200 | 650 | 12.6 | 12.5 | 12.4 | 38.2 |
| 5-31 | max:10.25 min:10.16 | max:4.45 min:4.37 | 7400 | 700 | 12.6 | 12.5 | 12.3 | 38.0 |

X For the binder type,
MC represents methyl cellulose,
PAA represents polyacryl amide and
PVA represents polyvinyl alcohol.

What is claimed is:

1. A process for preparing magnetically isotropic granulated powder, said process comprising the steps of: adding a binder, consisting of water and at least one of either methyl cellulose or polyacryl amide or polyvinyl alcohol, to a rare earth containing alloy powder;

stirring said powder and said binder to form a slurry; and spraying said slurry and drying the sprayed slurry with a rotary disk spray dryer apparatus to form a granulated powder.

2. A process for preparing magnetically isotropic granulated powder as claimed in claim 1, wherein an organic compound portion of said binder consists of less than 0.5 wt % of one member selected from the group consisting of methyl cellulose, polyacryl amide, and polyvinyl alcohol.

3. A process for preparing magnetically isotropic granulated powder as claimed in claim 1, wherein the organic compound portion of said binder consists of less than 0.4 wt % of two members selected from the group consisting of methyl cellulose, polyacryl amide, and polyvinyl alcohol.

4. A process for preparing magnetically isotropic granulated powder as claimed in claim 1, wherein said step of stirring is performed within a temperature range of from 0° C. to 15° C.

5. A process for preparing magnetically isotropic granulated powder as claimed in claim 1, wherein an oxygen content in a slurry receptor section or in a granulated powder collection section is always maintained at less than 3%.

6. A process for preparing magnetically isotropic granulated powder as claimed in claim 5, wherein said sprayed slurry is dried by a heated inert gas.

7. A process for preparing magnetically isotropic granulated powder as claimed in claim 6, wherein the temperature of the inert gas is in the range of from 60° C. to 150° C.

8. A process for preparing magnetically isotropic granulated powder as claimed in claim 1, wherein the average particle size of obtained granulated powders is in the range of from 20 μm to 400 μm.

9. A process for preparing magnetically isotropic granulated powder as claimed in claim 1, wherein said rare earth containing alloy powder is R-Fe-B alloy powder which has been demagnetized at a temperature in the range of from 400° C. to 700° C. and which is higher than the Curie point of said alloy powder.

10. A process for preparing magnetically isotropic granulated powder as claimed in claim 1, wherein said rare earth containing alloy powder is R-Fe-B alloy powder which has been wet-pulverized using water as a solvent.

11. A process for preparing magnetically anisotropic granulated powder, said process comprising the steps of: adding a binder, consisting of water and at least one member selected from the group consisting of methyl cellulose to polyacryl amide and polyvinyl alcohol, to a rare earth containing alloy powder;

stirring said powder and said binder to form a slurry; and spraying said slurry and drying the sprayed slurry with a rotary disk spray dryer apparatus having a rotary disk at least partially magnetized by a permanent magnet or an electromagnet, or a permanent magnet or an electromagnet appropriately disposed to apply a magnetic field in an appropriate position along the slurry supply route to the said rotary disk, to form a granulated powder.

12. A process for preparing magnetically anisotropic granulated powder as claimed in claim 11, wherein an organic compound portion of said binder consists of less than 0.5 wt % of one member selected from the group consisting of methyl cellulose, polyacryl amide, and polyvinyl alcohol.

13. A process for preparing magnetically anisotropic granulated powder as claimed in claim 11, wherein the organic compound portion of said binder consists of less than 0.4 wt % of two members selected from the group consisting of methyl cellulose, polyacryl amide, and polyvinyl alcohol.

14. A process for preparing magnetically anisotropic granulated powder as claimed in claim 11, wherein said step of stirring the binder is performed within a temperature range of from 0° C. to 15° C.

15. A process for preparing magnetically anisotropic granulated powder as claimed in claim 11, wherein an oxygen content in a slurry receptor section or in a granulated powder collection section is always maintained at less than 3%.

16. A process for preparing magnetically anisotropic granulated powder as claimed in claim 15, wherein said slurry is dried by a heated inert gas.

17. A process for preparing magnetically anisotropic granulated powder as claimed in claim 16, wherein the temperature of the inert gas is in the range of from 60° to 150° C.

18. A process for preparing magnetically anisotropic granulated powder as claimed in claim 11, wherein the average particle size of the obtained granulated powders is in the range of from 20 μm to 400 μm.

* * * * *

UNITED STATES PATENT AND TRADEMARK OFFICE

CERTIFICATE OF CORRECTION

PATENT NO. : 5,575,830

DATED : November 19, 1996

INVENTOR(S) : Yamashita et al.

It is certified that error appears in the above-indentified patent and that said Letters Patent is hereby corrected as shown below:

On the title page, item:

[30] Foreign Application Priority Data

| | | | |
|---|---|---|---|
| Dec. 27, 1993 | [JP] | Japan | .....5-350285 |
| Dec. 27, 1993 | [JP] | Japan | .....5-350286 |
| Dec. 27, 1993 | [JP] | Japan | .....5-350287 |
| Dec. 27, 1993 | [JP] | Japan | .....5-350288 |
| Sept. 14, 1994 | [JP] | Japan | .....6-247325 |
| Sept. 14, 1994 | [JP] | Japan | .....6-247326 |

Signed and Sealed this

Eighteenth Day of February, 1997

*Attest:*

Bruce Lehman

BRUCE LEHMAN

*Attesting Officer*

*Commissioner of Patents and Trademarks*